US012392356B2

(12) United States Patent
Lee et al.

(10) Patent No.: US 12,392,356 B2
(45) Date of Patent: Aug. 19, 2025

(54) FAN MODULE WITH A HEAT DISSIPATION FUNCTION

(71) Applicant: Delta Electronics, Inc., Taoyuan (TW)

(72) Inventors: Yang-Hsin Lee, Taoyuan (TW); Hsiu-Chuan Li, Taoyuan (TW); Chun-Nan Wu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 18/670,388

(22) Filed: May 21, 2024

(65) Prior Publication Data

US 2025/0230820 A1 Jul. 17, 2025

(30) Foreign Application Priority Data

Jan. 12, 2024 (CN) ..... 202410046796.8

(51) Int. Cl.

| | |
|---|---|
| ***F04D 29/58*** | (2006.01) |
| ***F04D 19/00*** | (2006.01) |
| ***F04D 25/06*** | (2006.01) |
| ***F04D 25/08*** | (2006.01) |
| ***F04D 29/053*** | (2006.01) |
| ***F04D 29/38*** | (2006.01) |

(52) U.S. Cl.

CPC ..... *F04D 29/582* (2013.01); *F04D 19/002* (2013.01); *F04D 25/082* (2013.01); *F04D 29/053* (2013.01); *F04D 29/38* (2013.01); *F04D 25/06* (2013.01)

(58) Field of Classification Search

CPC .... F04D 29/582; F04D 19/002; F04D 29/053; F04D 29/38; F04D 25/082; F04D 25/14; F04D 25/06; F04D 29/143; F04D 25/0613; F04D 29/329; G06F 1/203; H02K 5/207; Y10T 29/49245

USPC ..... 416/95

See application file for complete search history.

(56) References Cited

U.S. PATENT DOCUMENTS 7,061,155 B1 * 6/2006 Lee ..... H02K 5/10 417/373
9,472,991 B2 * 10/2016 Origlia ..... H02K 1/2791
(Continued)

FOREIGN PATENT DOCUMENTS

| | | |
|---|---|---|
| DE | 69824126 T2 | 9/2004 |
| EP | 0921318 B1 | 9/1999 |
| EP | 3540238 B1 | 9/2019 |

*Primary Examiner* — J. Todd Newton

(74) *Attorney, Agent, or Firm* — MUNCY, GEISSLER, OLDS & LOWE, P.C.

(57) ABSTRACT

A fan module includes a blade assembly, a rotating shaft assembly and a plate member. The blade assembly has a plurality of fan blades and a bottom plate. The bottom plate is connected to the fan blades, and at least one first opening and at least one protrusion are formed on the bottom plate. The rotating shaft assembly is affixed to the bottom plate and has at least one first slot and at least one second opening. The plate member is movably disposed between the bottom plate and the rotating shaft assembly, and the plate member has at least one second slot. The second slot is sleeved on the protrusion. When the rotating shaft assembly drives the blade assembly to rotate, the plate member rotates relative to the bottom plate, thereby selectively covering the first opening or exposing the first opening.

20 Claims, 19 Drawing Sheets

(56) References Cited

U.S. PATENT DOCUMENTS

2002/0141866 A1* 10/2002 Huang ..... F04D 25/082
415/220
2004/0126232 A1* 7/2004 Lin ..... F04D 25/0613
415/220
2005/0233688 A1* 10/2005 Franz ..... F04D 29/329
454/157
2006/0145567 A1* 7/2006 Lee ..... H02K 5/10
417/373
2006/0181163 A1* 8/2006 Lee ..... H02K 9/06
310/58
2011/0260032 A1* 10/2011 Horng ..... F04D 29/5806
248/678
2013/0149134 A1* 6/2013 Kobayashi ..... F04D 29/662
415/208.2
2013/0170967 A1* 7/2013 Chou ..... F04D 29/329
415/182.1
2021/0010484 A1* 1/2021 Ohno ..... F04D 29/584

* cited by examiner

FAN MODULE WITH A HEAT DISSIPATION FUNCTION

CROSS REFERENCE TO RELATED APPLICATIONS

This application claims the benefit of China Patent Application No. 202410046796.8, filed on Jan. 12, 2024, the entirety of which is incorporated by reference herein.

BACKGROUND OF THE INVENTION

Field of the Disclosure

The present disclosure relates to a fan module, and in particular it relates to a fan module with a heat dissipation function.

Description of the Related Art

As technology has developed, many of today's electronic devices (such as notebook computers) have become quite popular products nowadays. For the purpose of heat dissipation, the electronic devices are equipped with at least one fan module to assist the electronic device in dissipating heat.

Generally speaking, fan modules operate at high speed, so the heat energy generated by the fan module itself also affects the lifetime of the fan module. If heat dissipation holes are formed on the fan module for heat dissipation, external dust and water vapor may easily enter the fan module, which further reduces the lifetime of the fan module.

Therefore, how to design a fan module that can effectively dissipate heat is a topic nowadays that needs to be discussed and solved.

BRIEF SUMMARY OF THE INVENTION

Accordingly, one objective of the present disclosure is to provide a fan module to solve the above problems.

According to some embodiments of the disclosure, a fan module is provided. The fan module includes a blade assembly, a rotating shaft assembly and a plate member. The blade assembly has a plurality of fan blades and a bottom plate. The bottom plate is connected to the fan blades. At least one first opening and at least one protrusion are formed on the bottom plate. The rotating shaft assembly is affixed to the bottom plate, and the rotating shaft assembly has at least one first slot and at least one second opening. The first slot corresponds to the at least one protrusion, and the at least one second opening corresponds to the at least one first opening. The plate member is movably disposed between the bottom plate and the rotating shaft assembly, and the plate member has at least one second slot. The at least one second slot is sleeved on the at least one protrusion, and the size of the at least one second slot is greater than the size of the at least one protrusion. When the rotating shaft assembly drives the blade assembly to rotate, the plate member rotates relative to the bottom plate, thereby selectively shielding the first opening or exposing the first opening.

According to some embodiments, the plate member further has at least one third opening, and when the plate member rotates relative to the bottom plate to expose the at least one first opening, the at least one third opening overlaps the at least one first opening and the at least one second opening.

According to some embodiments, the at least one protrusion has a platform structure and a protruding structure, the platform structure extends from the bottom plate along a rotating axis of the rotating shaft assembly, and the protruding structure extends and protrudes from the platform structure along the rotating axis.

According to some embodiments, the plate member further has a disc structure and a lateral protruding structure, the lateral protruding structure extends radially from the disc structure, the at least one third opening is formed on the disc structure, and the at least one second slot is formed on the lateral protruding structure.

According to some embodiments, the thickness of the plate member is less than the height of the platform structure along the rotating axis.

According to some embodiments, the at least one second slot is sleeved on the platform structure, and the shape of the platform structure corresponds to the shape of the at least one second slot, so that the platform structure guides the lateral protruding structure to move relative to the bottom plate.

According to some embodiments, the platform structure is configured to support the rotating shaft assembly. The size of the at least one first slot matches the size of the protruding structure, and the size of the at least one first slot is smaller than the size of the platform structure.

According to some embodiments, the blade assembly is made of a plastic material, and the protruding structure is processed through a hot melt process or a hot riveting process, so that the rotating shaft assembly is affixed to the blade assembly through the protruding structure, which is processed by the hot melt process or the hot riveting process.

According to some embodiments, when the rotating shaft assembly rotates in a first rotational direction, the plate member rotates in the first rotational direction relative to the bottom plate, so that the at least one third opening overlaps the at least one first opening to expose the at least one first opening.

According to some embodiments, when the rotating speed of the rotating shaft assembly in the first rotational direction decreases, the rotating speed of the plate member in the first rotational direction is greater than a rotating speed of the blade assembly and the rotating shaft assembly, so that the plate member shields the at least one first opening.

According to some embodiments, when the rotating shaft assembly rotates in a second rotational direction, the plate member rotates in the second rotational direction relative to the bottom plate, so that the plate member shields the at least one first opening. The second rotational direction is opposite to the first rotational direction.

According to some embodiments of the disclosure, a fan module is provided. The fan module includes a blade assembly, a rotating shaft assembly and a plate member. The blade assembly has a plurality of fan blades and a bottom plate, the bottom plate is connected to the fan blades, and at least one first opening is formed on the bottom plate. The rotating shaft assembly is affixed to the bottom plate, the rotating shaft assembly has at least one first protrusion and at least one second opening, and the at least one second opening corresponds to the at least one first opening. The plate member is movably disposed on the rotating shaft assembly, and the plate member has at least one opening groove. The at least one opening groove is sleeved on the at least one first protrusion, and the size of the at least one opening groove is larger than the size of the at least one first protrusion. When the rotating shaft assembly drives the blade assembly to rotate, the plate member rotates relative to the bottom plate, thereby selectively shielding the first opening or exposing the first opening.

According to some embodiments, the fan module further includes a blocking member, which is fixedly disposed on a shaft of the rotating shaft assembly, and when viewed in a direction perpendicular to the shaft, the plate member is disposed between the blocking member and the bottom plate. There is a gap between the blocking member and the plate member.

According to some embodiments, at least one second protrusion is formed on the bottom plate and passes through the rotating shaft assembly, the plate member has a disc structure, and the disc structure does not contact the at least one second protrusion. The plate member further has at least a third opening corresponding to the at least one second opening, and when viewed along a rotating axis of the shaft, the at least one third opening is located between the at least one second protrusion and the at least one first protrusion.

According to some embodiments of the disclosure, a fan module is provided and includes a blade assembly, a rotating shaft assembly and a plate member. The blade assembly has a plurality of fan blades and a bottom plate. The bottom plate is connected to the fan blades, and at least one first opening and at least one protrusion are formed on the bottom plate. The rotating shaft assembly is fixedly disposed on the bottom plate, and the rotating shaft assembly has at least one first slot and at least one second opening. The first slot corresponds to the at least one protrusion, and the at least one second opening corresponds to the at least one first opening. The plate member is movably disposed on the rotating shaft assembly, and the plate member having at least one second slot. The at least one second slot is sleeved on the at least one protrusion, and the size of the at least one second slot is greater than the size of the at least one protrusion. When the rotating shaft assembly drives the blade assembly to rotate, the plate member rotates relative to the rotating shaft assembly, thereby selectively shielding the first opening or exposing the first opening.

According to some embodiments, the fan module further includes a blocking member which is fixedly disposed on a shaft of the rotating shaft assembly, and when viewed in a direction perpendicular to the shaft, the plate member is disposed between the blocking member and the bottom plate. There is a gap between the blocking member and the plate member.

According to some embodiments of the disclosure, the plate member further has at least one third opening corresponding to the at least one first opening and the at least one second opening, and when the plate member rotates relative to the bottom plate to expose the at least one first opening, the at least one third opening overlaps the at least one first opening and the at least one second opening.

According to some embodiments of the disclosure, a fan module is provided and includes a blade assembly, a rotating shaft assembly and a plate member. The blade assembly has a plurality of fan blades and a bottom plate, the bottom plate is connected to the fan blades, at least one first opening and at least one protrusion are formed on the bottom plate, and the at least one protrusion is formed from an outer surface of the bottom plate. The rotating shaft assembly is fixedly disposed on an inner surface of the bottom plate, and the rotating shaft assembly has at least one second opening. The at least one second opening corresponds to the at least one first opening. The plate member is movably disposed on the outer surface, and the plate member has at least one opening groove. The at least one opening groove is sleeved on the at least one protrusion, and the size of the at least one opening groove is greater than the size of the at least one protrusion. When the rotating shaft assembly drives the blade assembly to rotate, the plate member rotates relative to the bottom plate, thereby selectively shielding the first opening or exposing the first opening.

According to some embodiments, the fan module further includes a blocking member which is fixedly disposed on a shaft of the rotating shaft assembly, and when viewed in a direction perpendicular to the shaft, the plate member is disposed between the blocking member and the bottom plate. There is a gap between the blocking member and the plate member.

According to some embodiments, the plate member further has at least one third opening corresponding to the at least one first opening, and when the plate member rotates relative to the bottom plate to expose the at least one first opening, the at least one third opening overlaps the at least one first opening and the at least one second opening.

The present disclosure provides a fan module which includes a blade assembly, a rotating shaft assembly and a plate member. In some embodiments, the rotating shaft assembly is affixed to the blade assembly, at least one first opening is formed on the first base body of the blade assembly, and at least one second opening is formed on the second base body of the rotating shaft assembly for aligning with the first opening. At least one third opening is formed on the plate member for corresponding to the first opening and the second opening.

When the fan module is operating normally, the rotating shaft assembly drives the blade assembly to rotate, and the plate member rotates with the blade assembly so that the third opening is aligned with the first opening and the second opening, and therefore the fan module can effectively dissipate heat during operation.

Before the operation of the fan module is stopped, the rotating shaft assembly can be rotated in the opposite direction or the rotation speed can be reduced, so that the plate member rotates relative to the blade assembly or the rotating shaft assembly, thereby shielding the first opening and the second opening. Therefore, after the fan module stops operating, it can effectively isolate external dust or moisture from entering its interior, thereby increasing the service life of the fan module.

Additional features and advantages of the disclosure will be set forth in the description which follows, and, in part, will be obvious from the description, or can be learned by practice of the principles disclosed herein. The features and advantages of the disclosure can be realized and obtained by means of the instruments and combinations pointed out in the appended claims. These and other features of the disclosure will become more fully apparent from the following description and appended claims, or can be learned by the practice of the principles set forth herein.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION OF THE INVENTION

Figure 1:
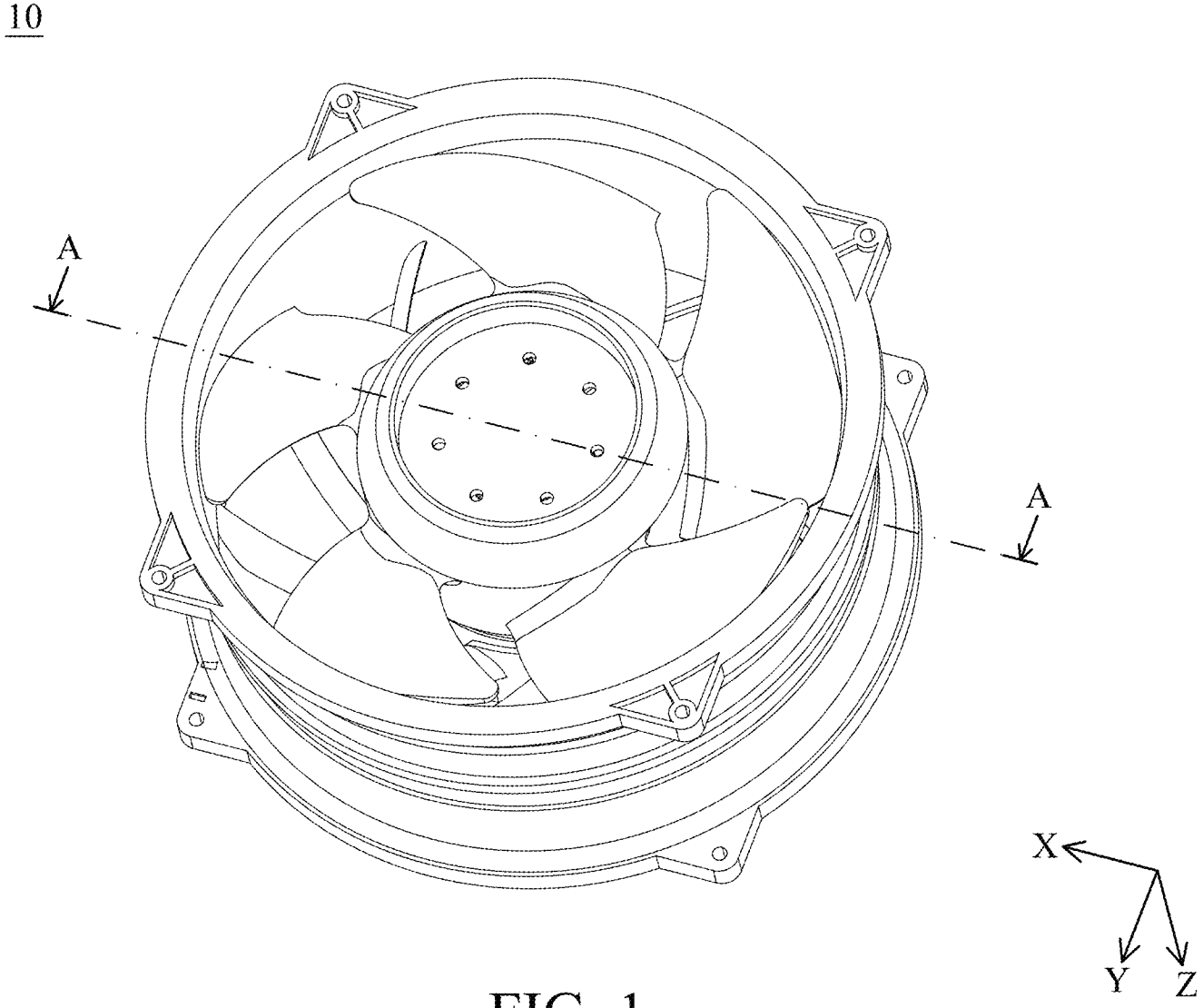
FIG. 1 is a three-dimensional schematic diagram of a fan module 10 according to an embodiment of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are in direct contact, and may also include embodiments in which additional features may be disposed between the first and second features, such that the first and second features may not be in direct contact.

In addition, the present disclosure may repeat reference numerals and/or letters in the various examples. This repetition is for the purpose of simplicity and clarity and does not in itself dictate a relationship between the various embodiments and/or configurations discussed. Moreover, the formation of a feature on, connected to, and/or coupled to another feature in the present disclosure that follows may include embodiments in which the features are in direct contact, and may also include embodiments in which additional features may be disposed interposing the features, such that the features may not be in direct contact. In addition, spatially relative terms, for example, "vertical," "above," "over," "below,", "bottom," etc. as well as derivatives thereof (e.g., "downwardly," "upwardly," etc.) are used in the present disclosure for ease of description of one feature's relationship to another feature. The spatially relative terms are intended to cover different orientations of the device, including the features.

Unless defined otherwise, all technical and scientific terms used herein have the same meaning as commonly understood by one of ordinary skill in the art to which this disclosure belongs. It should be appreciated that each term, which is defined in a commonly used dictionary, should be interpreted as having a meaning conforming to the relative skills and the background or the context of the present disclosure, and should not be interpreted in an idealized or overly formal manner unless defined otherwise.

Use of ordinal terms such as "first", "second", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

In addition, in some embodiments of the present disclosure, terms concerning attachments, coupling and the like, such as "connected" and "interconnected", refer to a relationship wherein structures are secured or attached to one another either directly or indirectly through intervening structures, as well as both movable or rigid attachments or relationships, unless expressly described otherwise.

Figure 2:
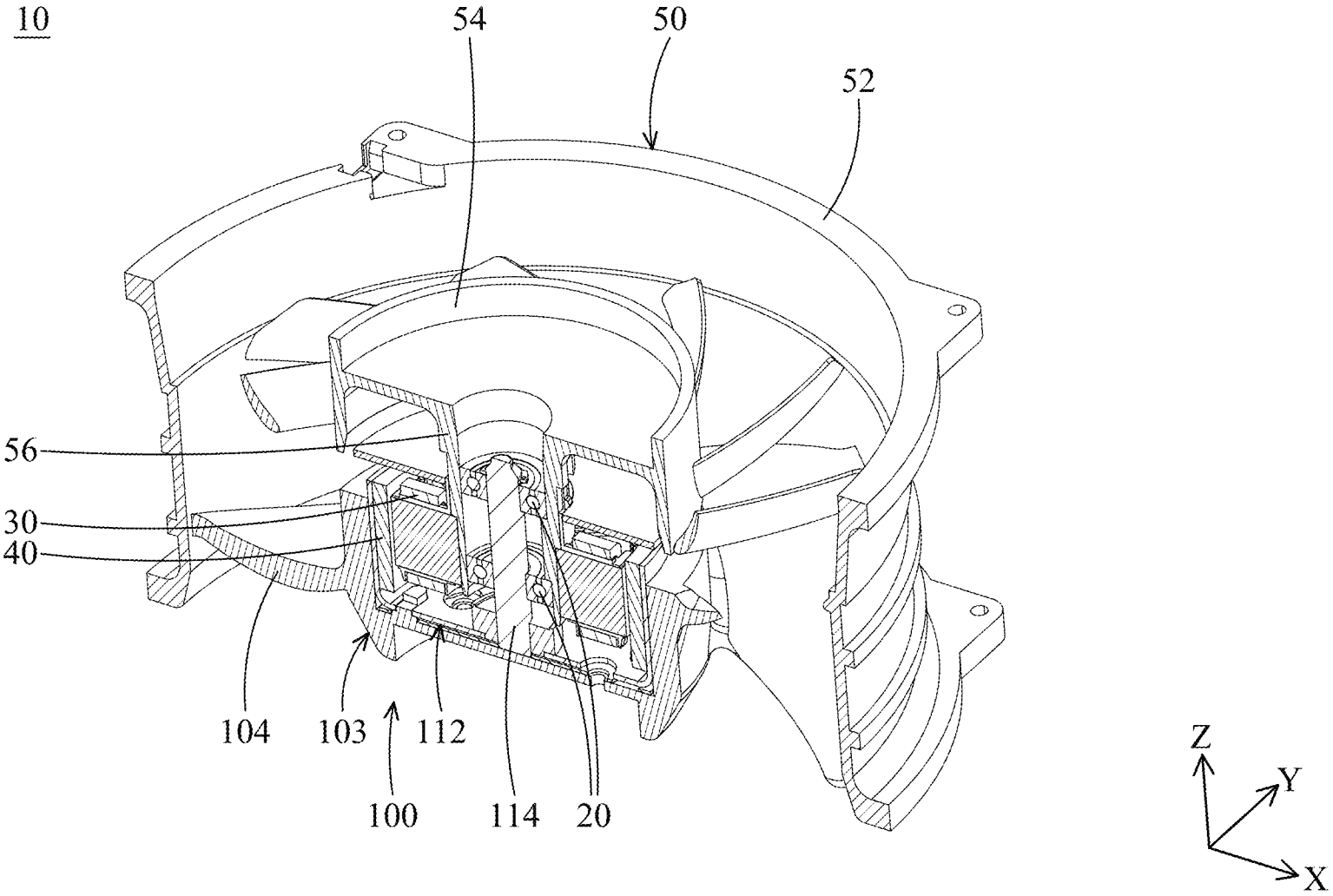
FIG. 2 is a three-dimensional cross-sectional view of the fan module 10 along the line A-A in FIG. 1 according to an embodiment of the present disclosure.

Please refer to FIG. 1 and FIG. 2. FIG. 1 is a three-dimensional schematic diagram of a fan module 10 according to an embodiment of the present disclosure, and FIG. 2 is a three-dimensional cross-sectional view of the fan module 10 along the line A-A in FIG. 1 according to an embodiment of the present disclosure. The fan module 10 may include a fixed assembly 50 and a rotating assembly 100. The rotating assembly 100 can rotate relative to the fixed assembly 50.

The fixed assembly 50 may include a fixed housing 52, a central fixed structure 54, and a central tubular portion 56. The central fixed structure 54 is affixed to the fixed housing 52, and the central tubular portion 56 is affixed to the central fixed structure 54. The fixed housing 52, the central fixed structure 54 and the central tubular portion 56 can be integrally formed as one piece, for example, made of plastic material.

Figure 3:
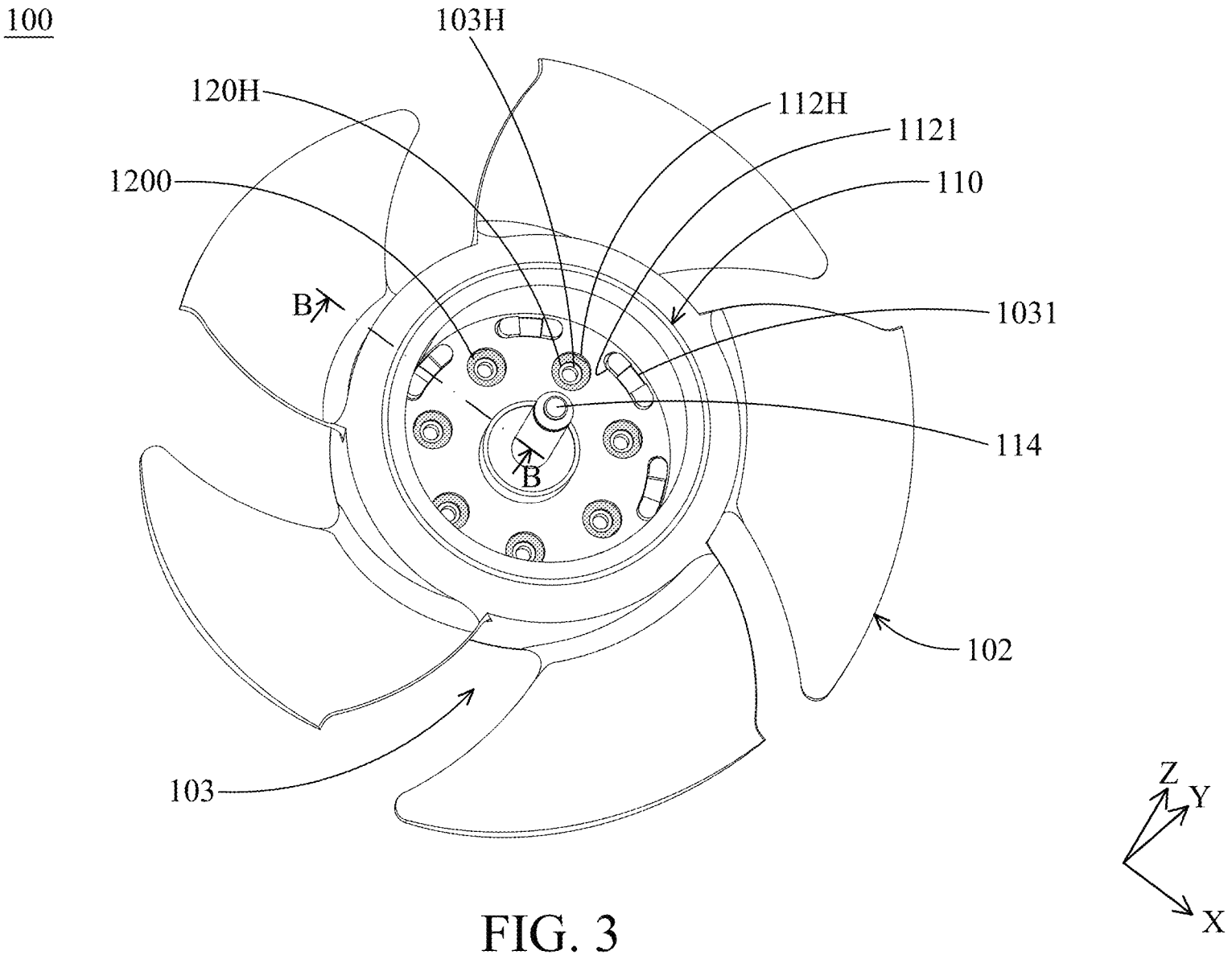
FIG. 3 is a three-dimensional schematic diagram of the rotating assembly 100 according to an embodiment of the present disclosure.
Figure 4:
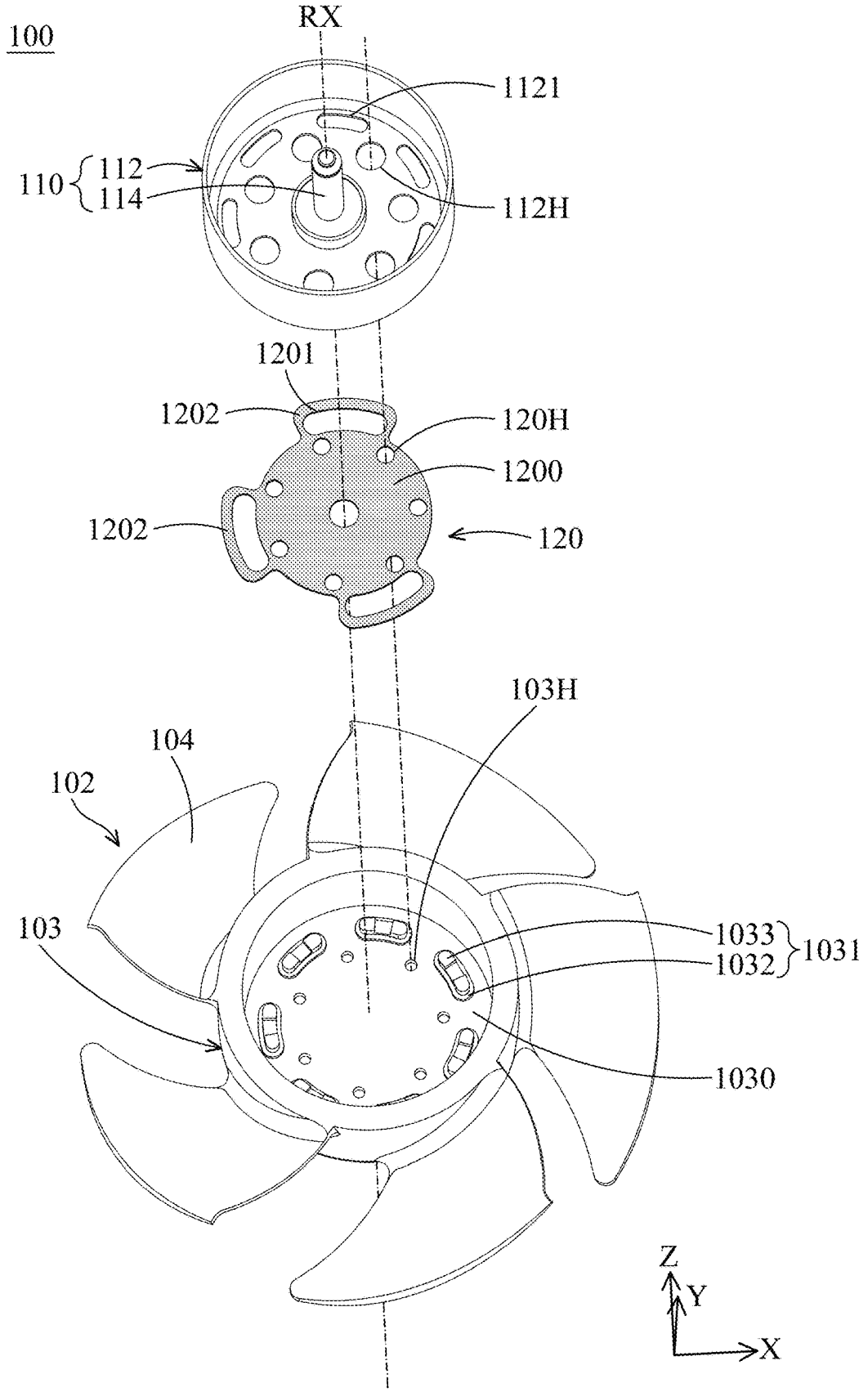
FIG. 4 is an exploded diagram of the rotating assembly 100 according to an embodiment of the present disclosure.

Next, please refer to FIG. 1 to FIG. 4. FIG. 3 is a three-dimensional schematic diagram of the rotating assembly 100 according to an embodiment of the present disclosure, and FIG. 4 is an exploded diagram of the rotating assembly 100 according to an embodiment of the present disclosure. The rotating assembly 100 may include a blade assembly 102, a rotating shaft assembly 110 and a plate member 120. The blade assembly 102 includes a first base body 103 and a plurality of fan blades 104, and the fan blades 104 are fixedly connected to the first base body 103. The rotating shaft assembly 110 includes a second base body 112 and a shaft 114. The shaft 114 is fixedly connected to the second base body 112.

The fan module 10 further includes two bearings 20, a plurality of coils 30 and a magnet 40. The coil 30 is fixedly disposed on the central tubular portion 56, the magnet 40 is affixed to the second base body 112, and the bearings 20 are disposed between the shaft 114 and the central tubular portion 56. When the coil 30 is energized and interacts with the magnet 40, the rotating assembly 100 can be driven to rotate.

In this embodiment, the first base body 103 has a bottom plate 1030 which is connected to the fan blades 104, and at least one first opening 103H and at least one protrusion 1031 are formed on the bottom plate 1030. For example, the first base body 103 of this embodiment has seven first openings 103H and seven protrusion 1031, but they are not limited thereto.

The rotating shaft assembly 110 is fixedly disposed on the bottom plate 1030, and the second base body 112 of the rotating shaft assembly 110 has at least one first slot 1121 and at least one second opening 112H. The first slot 1121 corresponds to the corresponding protrusion 1031, and the second opening 112H corresponds to the corresponding first opening 103H.

The plate member 120 is movably disposed between the bottom plate 1030 and the rotating shaft assembly 110, and the plate member 120 has at least one second slot 1201 and at least one third opening 120H. The second slot 1201 sheathes on the corresponding protrusion 1031, and the size of second slot 1201 is larger than the size of protrusion 1031.

Specifically, the plate member 120 has a disc structure 1200 and at least one lateral protruding structure 1202, and the lateral protruding structure 1202 extends radially from the disc structure 1200. The third opening 120H is formed on the disc structure 1200, and the second slot 1201 is formed on the lateral protruding structure 1202. The number of third opening 120H is equal to the number of first opening 103H or to the number of second opening 112H.

When the magnet 40 acts with the coil 30 so that the magnet 40 and the rotating shaft assembly 110 drive the blade assembly 102 to rotate, the plate member 120 rotates relative to the bottom plate 1030, thereby selectively shielding the first opening 103H or exposing the first opening 103H.

As shown in FIG. 3, when the plate member 120 rotates relative to the bottom plate 1030 to expose the first opening 103H, the third opening 120H overlaps the corresponding first opening 103H and the corresponding second opening 112H.

Figure 5:
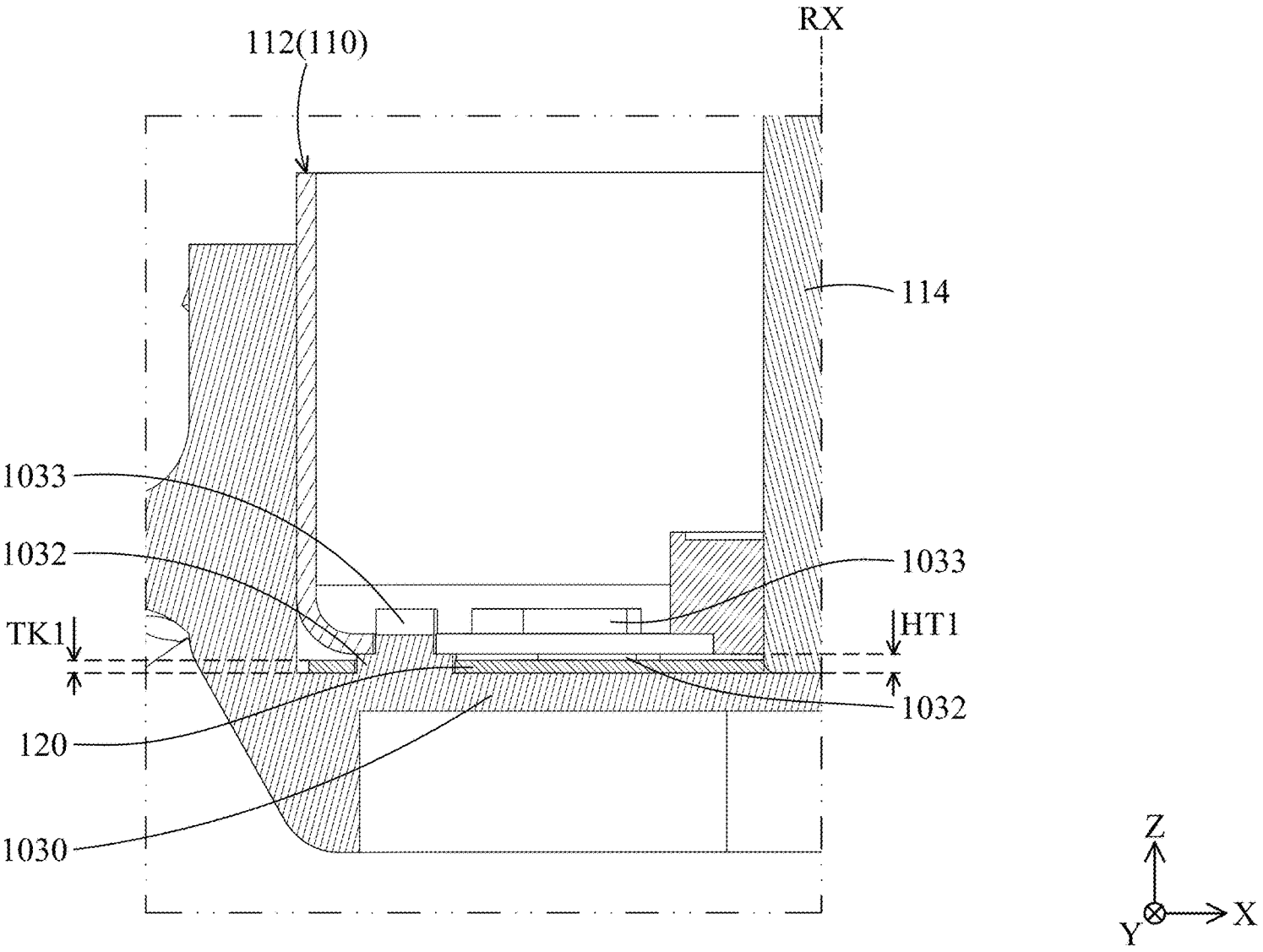
FIG. 5 is a cross-sectional view of the rotating assembly 100 along line B-B in FIG. 3 according to an embodiment of the present disclosure.

Please refer to FIG. 3 to FIG. 5. FIG. 5 is a cross-sectional view of the rotating assembly 100 along line B-B in FIG. 3 according to an embodiment of the present disclosure. As shown in FIG. 4 and FIG. 5, the protrusion 1031 has a platform structure 1032 and a protruding structure 1033. The platform structure 1032 extends from the bottom plate 1030 along a rotating axis RX of the rotating shaft assembly 110, and the protruding structure 1033 extends and protrudes from the platform structure 1032 along the rotating axis RX.

As shown in FIG. 5, the thickness TK1 of the plate member 120 is smaller than the height HT1 of the platform structure 1032 along the rotating axis RX. That is, the second base body 112 does not contact the plate member 120, so that the plate member 120 can move relative to the bottom plate 1030.

Furthermore, the second slot 1201 sheathes on the platform structure 1032, and the shape of the platform structure 1032 corresponds to the shape of the second slot 1201, so that the platform structure 1032 can guide the lateral protruding structure 1202 to move relative to the bottom plate 1030.

As shown in FIG. 3 and FIG. 5, the platform structure 1032 is configured to support the second base body 112 of the rotating shaft assembly 110, the size of the first slot 1121 matches the size of the protruding structure 1033, and the size of the first slot 1121 is smaller than the size of platform structure 1032. For example, the first slot 1121 and the protruding structure 1033 are co-shape, and the size of the first slot 1121 is equal to or slightly larger than the size of the protruding structure 1033, such as larger than 5%.

In this embodiment, the blade assembly 102 is made of plastic material, and the rotating shaft assembly 110 can be made of metal material. Therefore, the protruding structure 1031 can be processed through a hot melt process or a hot riveting process, so that the rotating shaft assembly 110 is affixed to the blade assembly 102 through the protruding structure 1033 which is processed by the process. For example, the size of the protruding structure 1033 that has undergone the hot riveting process is larger than the size of the first slot 1121 so as to affix the rotating shaft assembly 110 to the bottom plate 1030.

Figure 6:
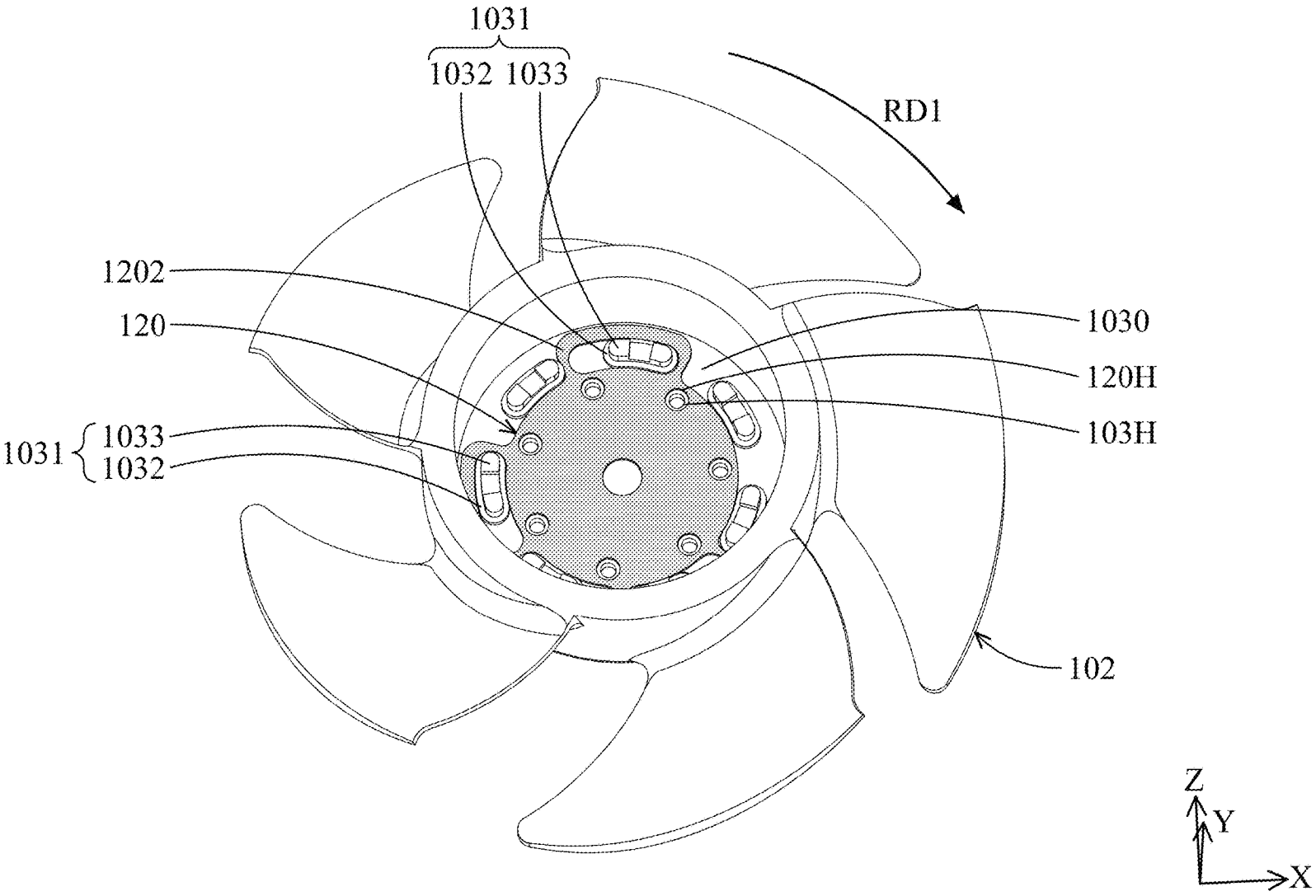
FIG. 6 is a schematic three-dimensional diagram illustrating that the plate member 120 is located in an open position according to an embodiment of the present disclosure.
Figure 7:
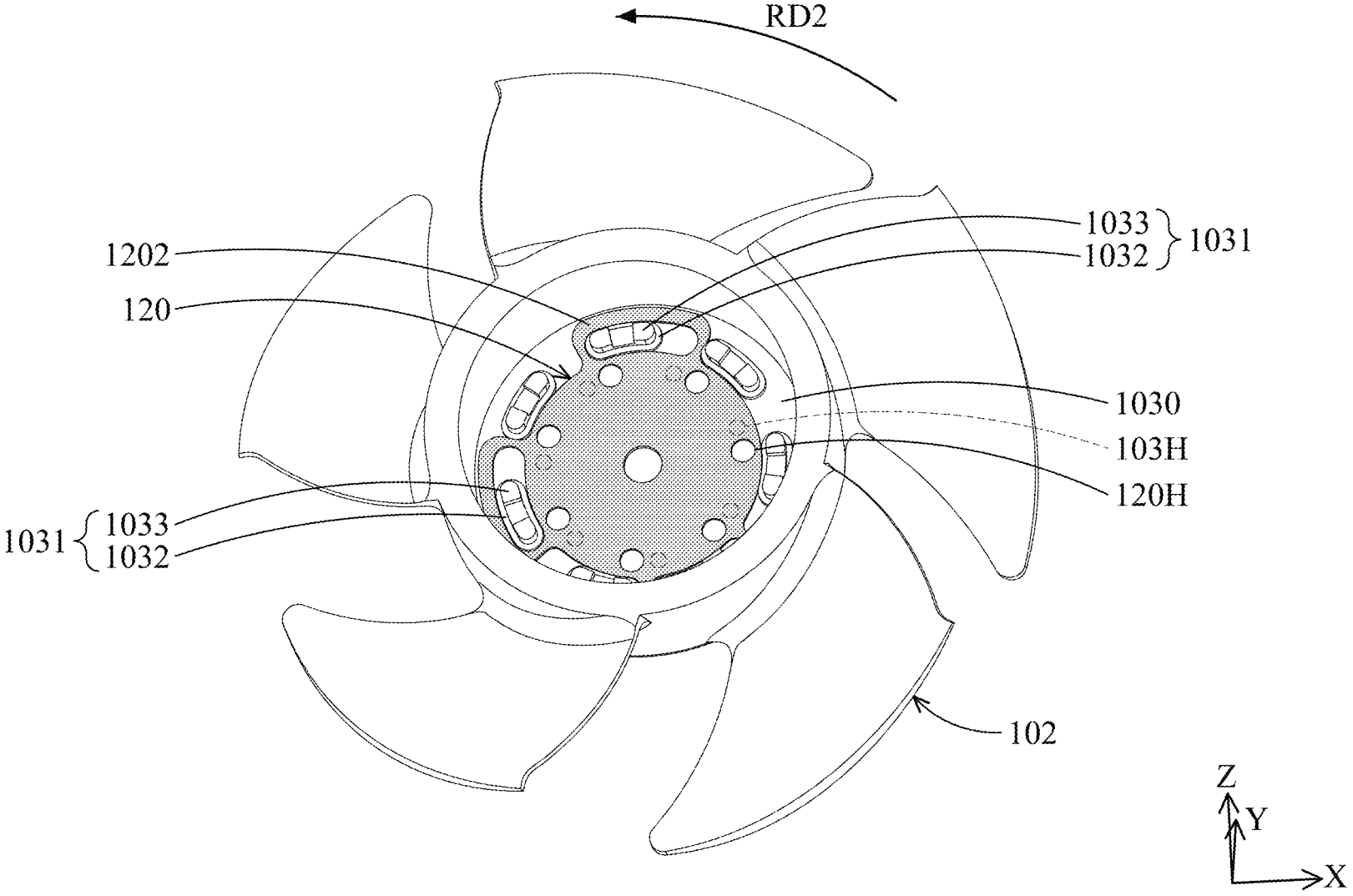
FIG. 7 is a schematic three-dimensional diagram illustrating that the plate member 120 is located in a closed position according to an embodiment of the present disclosure.

Next, please refer to FIG. 3, FIG. 6 and FIG. 7. FIG. 6 is a schematic three-dimensional diagram illustrating that the plate member 120 is located in an open position according to an embodiment of the present disclosure, and FIG. 7 is a schematic three-dimensional diagram illustrating that the plate member 120 is located in a closed position according to an embodiment of the present disclosure. When the rotating shaft assembly 110 rotates in a first rotational direction RD1, the platform structure 1032 of the protrusion 1031 is in contact with one side of the lateral protruding structure 1202 (the right side in FIG. 6) to drive the plate member 120 to rotate relative to the bottom plate 1030 in the first rotational direction RD1 so that the third opening 120H overlaps the corresponding first opening 103H to expose the first opening 103H.

On the other hand, as shown in FIG. 7, when the rotating shaft assembly 110 rotates in a second rotational direction RD2, the platform structure 1032 of the protrusion 1031 is in contact with the other side of the lateral protruding structure 1202 (the left side in FIG. 7) in order to drive the plate member 120 to rotate in the second rotational direction RD2 relative to the bottom plate 1030, so that the plate member 120 shields the first opening 103H. The second rotational direction RD2 is opposite to the first rotational direction RD1.

The manner of the plate member 120 shielding the first opening 103H is not limited to the above embodiment. For example, in some embodiments, when the rotating speed of the rotating shaft assembly 110 in the first rotational direction RD1 decreases, for example, from 500 rpm (Revolution Per Minute) to 50 or approaches 0 rpm, the rotating speed of the plate member 120 in the first rotational direction RD1 is greater than the rotating speed of the blade assembly 102 and the rotating shaft assembly 110, so that the plate member 120 will shield the first opening 103H. For example, when the blade assembly 102 and the rotating shaft assembly 110 brake, the plate member 120 will continue to rotate in the first rotational direction RD1 due to inertia, thereby shielding the first opening 103H.

Figure 8:
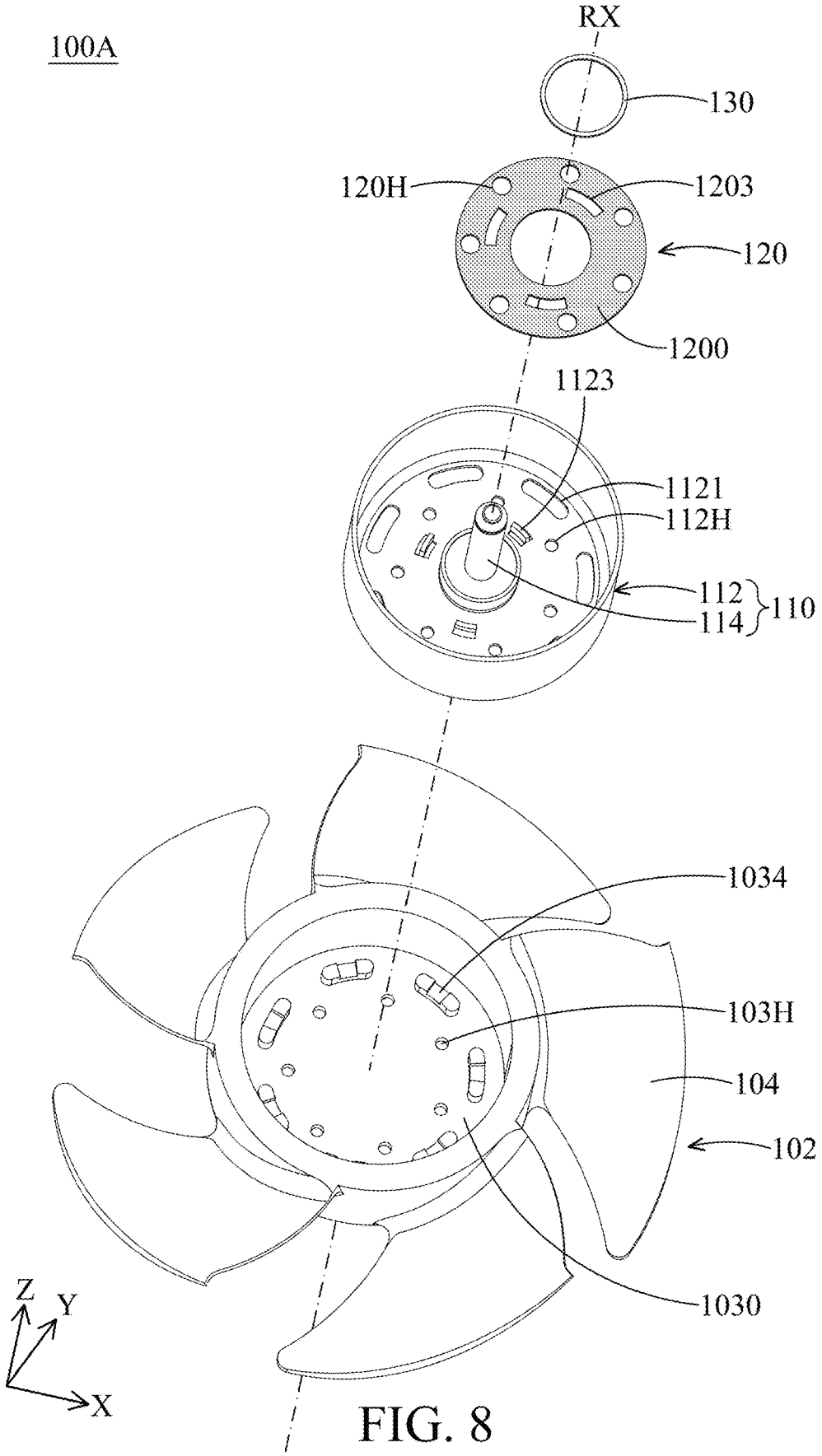
FIG. 8 is an exploded diagram of a rotating assembly 100A according to another embodiment of the present disclosure.
Figure 9:
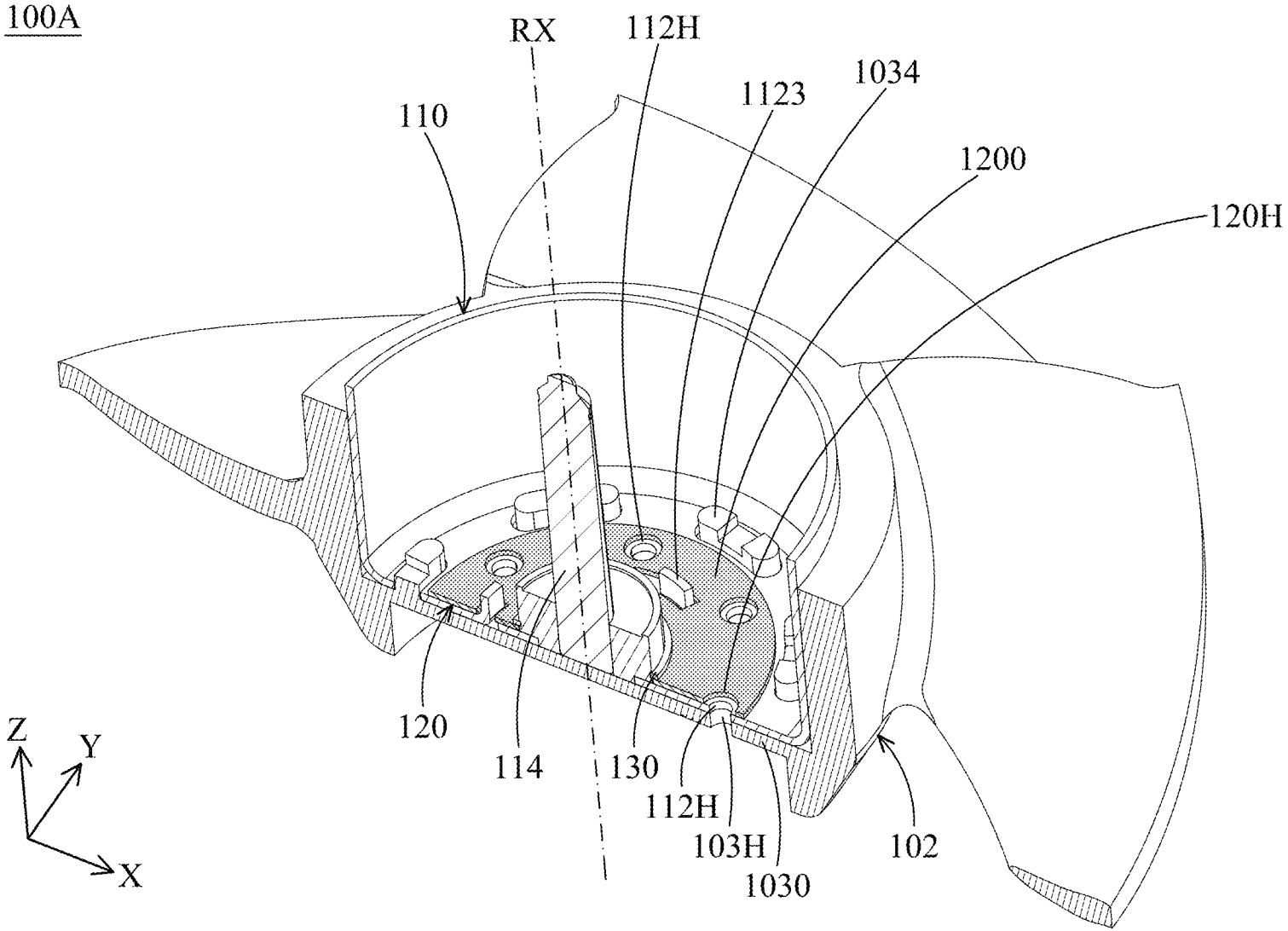
FIG. 9 is a perspective cross-sectional view of the rotating assembly 100A according to another embodiment of the present disclosure.
Figure 10:
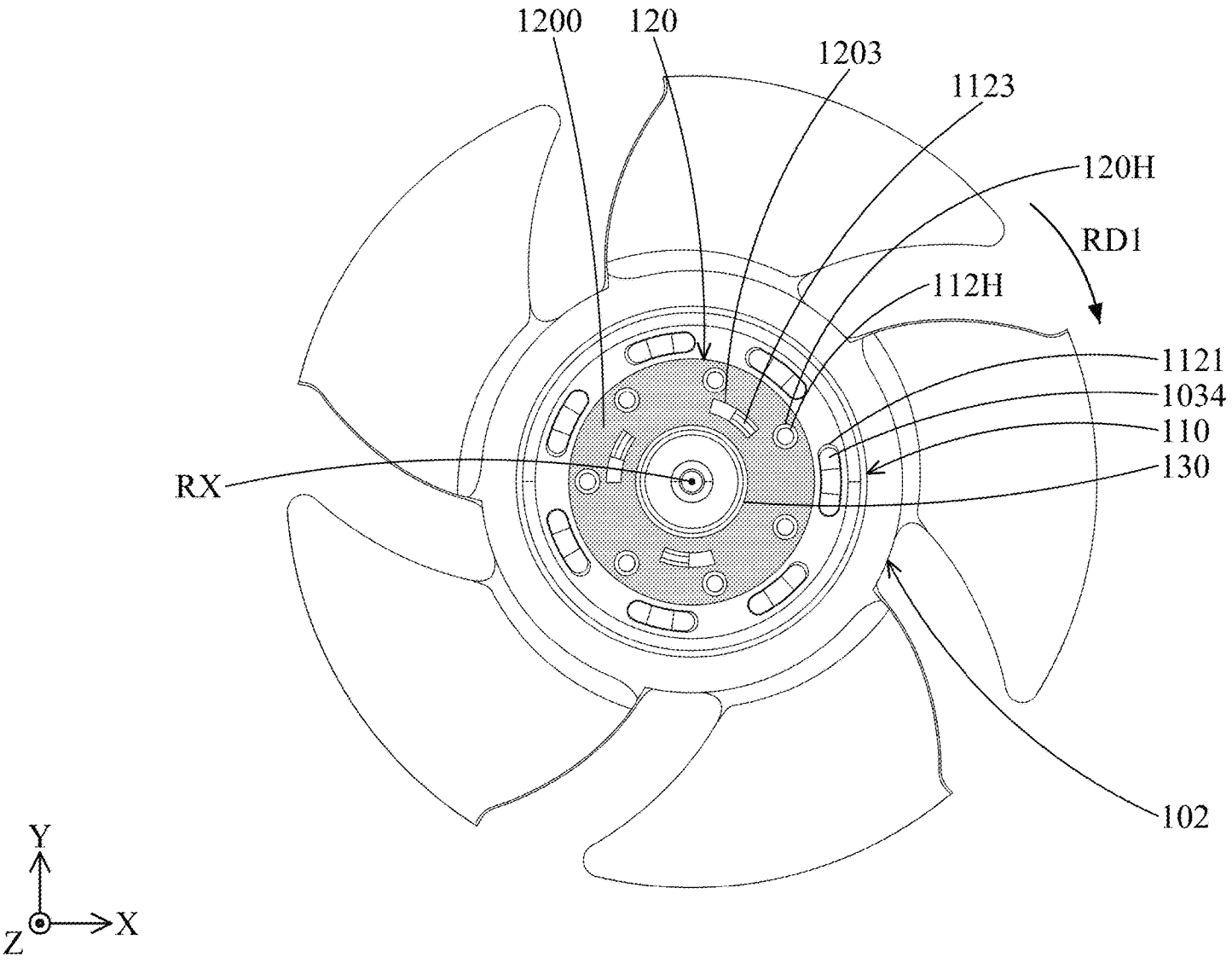
FIG. 10 is a three-dimensional schematic diagram illustrating that the plate member 120 is located in the open position according to another embodiment of the present disclosure.
Figure 11:
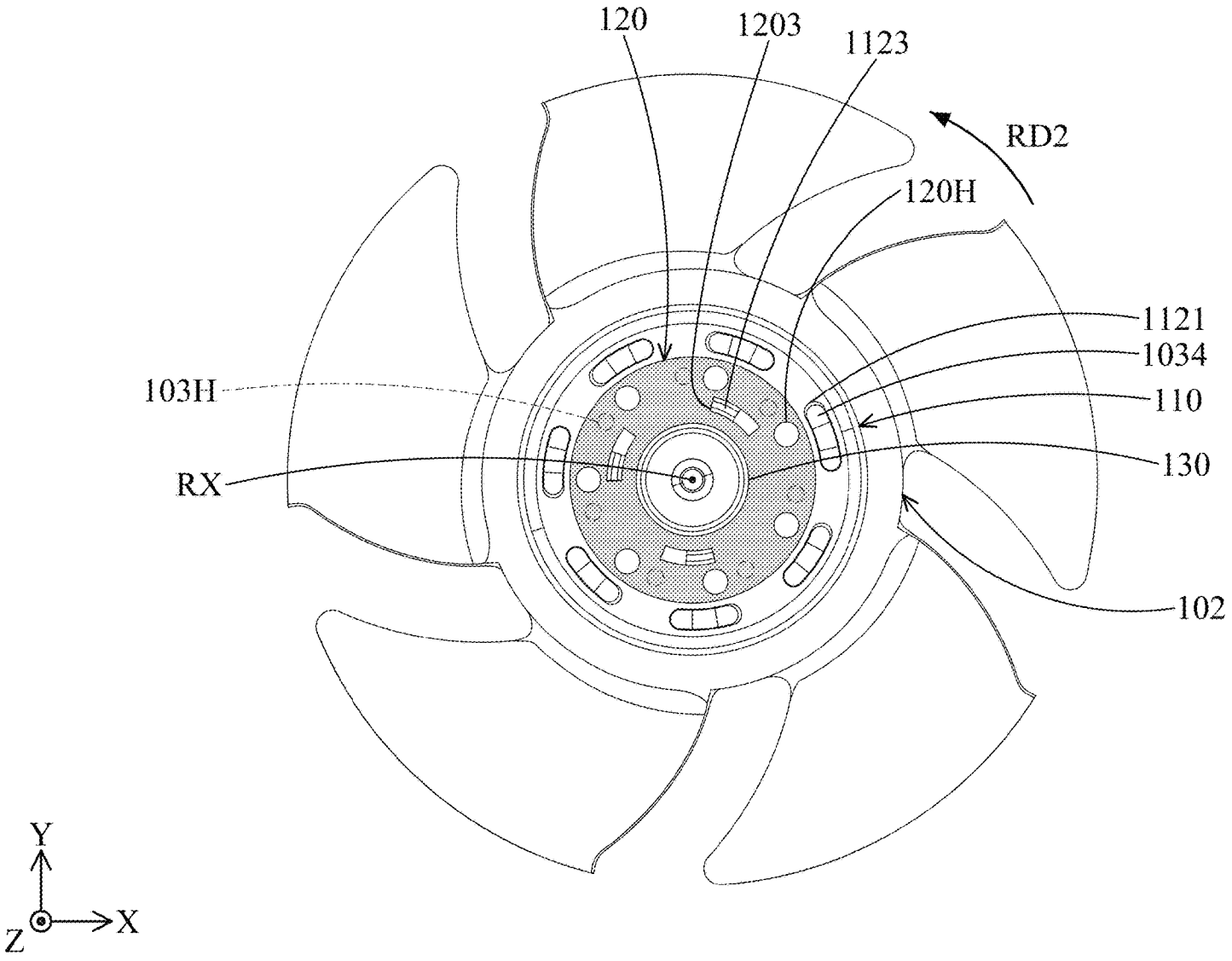
FIG. 11 is a three-dimensional schematic diagram illustrating that the plate member 120 is located in the closed position according to another embodiment of the present disclosure.

Next, please refer to FIG. 8 to FIG. 11. FIG. 8 is an exploded diagram of a rotating assembly 100A according to another embodiment of the present disclosure, FIG. 9 is a perspective cross-sectional view of the rotating assembly 100A according to another embodiment of the present disclosure, FIG. 10 is a three-dimensional schematic diagram illustrating that the plate member 120 is located in the open position according to another embodiment of the present disclosure, and FIG. 11 is a three-dimensional schematic diagram illustrating that the plate member 120 is located in the closed position according to another embodiment of the present disclosure.

Similar to the previous embodiment, the rotating assembly 100A has the blade assembly 102, the rotating shaft assembly 110 and the plate member 120. In this embodiment, the rotating shaft assembly 110 is fixedly disposed on the bottom plate 1030. The rotating shaft assembly 110 has at least one first protrusion 1123 and at least one second opening 112H, and the second opening 112H corresponds to the first opening 103H of the bottom plate 1030.

Furthermore, the plate member 120 is movably disposed on the rotating shaft assembly 110, and the plate member 120 has at least one opening groove 1203. The opening groove 1203 is sleeved on the corresponding first protrusion 1123, and the size of the opening groove 1203 is larger than the size of the first protrusion 1123.

As shown in FIG. 10, when the rotating shaft assembly 110 drives the blade assembly 102 to rotate, the first protrusion 1123 is in contact with one side of the opening groove 1203 (the right side in FIG. 10) to drive the plate member 120 to rotate relative to the rotating shaft assembly 110 so that the third opening 120H is aligned with the second opening 112H and the first opening 103H so as to expose the first opening 103H.

In addition, as shown in FIG. 11, when the rotating shaft assembly 110 rotates in the second rotational direction RD2, the first protrusion 1123 is in contact with the other side of the opening groove 1203 (the left side in FIG. 11) to drive the plate member 120 to rotate in the second rotational direction RD2 relative to the rotating shaft assembly 110 so that the plate member 120 shields the first opening 103H.

It is worth noting that the rotating assembly 100A may further include a blocking member 130 which is fixedly disposed on the shaft 114 of the rotating shaft assembly 110, and as shown in FIG. 9, when viewed in a direction perpendicular to the shaft 114 (such as the Y-axis), the plate member 120 is disposed between the blocking member 130 and the bottom plate 1030.

Because the plate member 120 is not fixed on the rotating shaft assembly 110, when the rotating shaft assembly 110 rotates, the blocking member 130 is configured to block the plate member 120 to avoid the problem that the plate member 120 may be detached from the rotating shaft assembly 110. In addition, it should be noted that there is a gap between the blocking member 130 and the plate member 120. That is, the blocking member 130 does not press the plate member 120 to ensure that the plate member 120 can rotate relative to the second base body 112.

In addition, in this embodiment, at least one second protrusion 1034 is further formed on the bottom plate 1030 and passes through the first slot 1121 of the rotating shaft assembly 110. Furthermore, the plate member 120 has a disc structure 1200, and the disc structure 1200 does not contact the second protrusion 1034. As shown in FIG. 11, when viewed along the rotating axis RX, the third opening 120H is located between the second protrusion 1034 and the first protrusion 1123.

Figure 12:
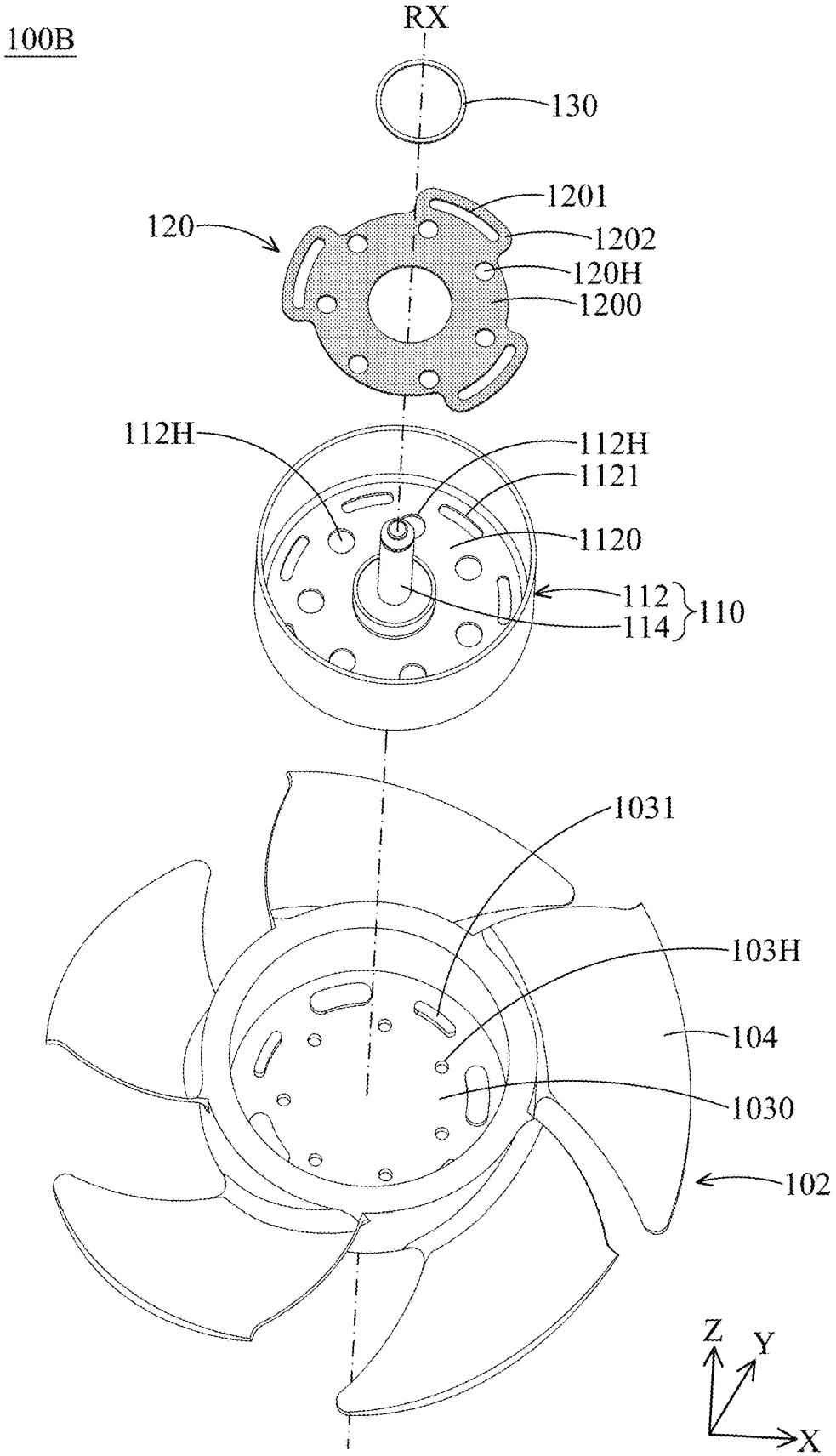
FIG. 12 is an exploded diagram of the rotating assembly 100B according to another embodiment of the present disclosure.
Figure 13:
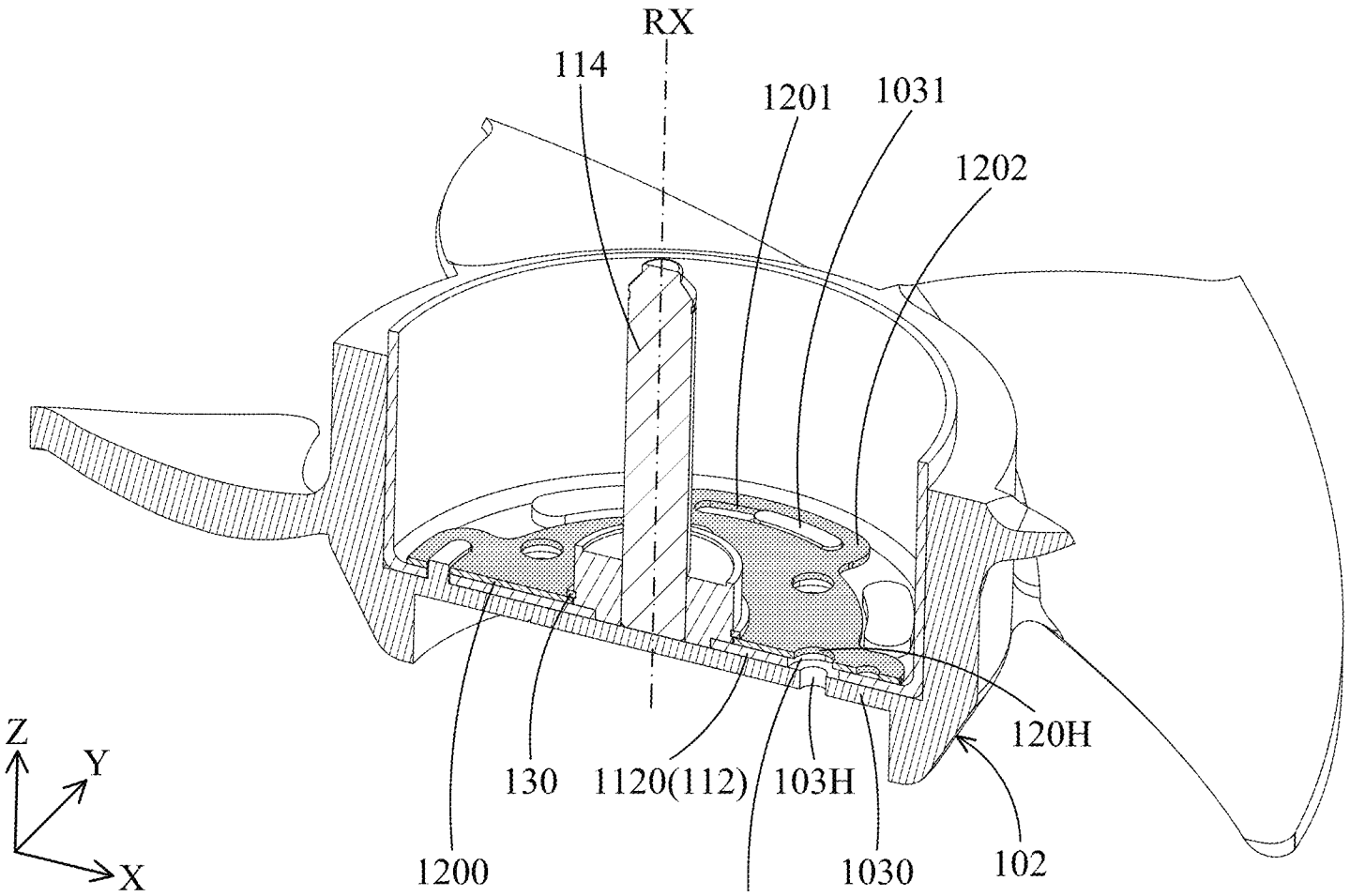
FIG. 13 is a perspective cross-sectional view of the rotating assembly 100B according to another embodiment of the present disclosure.
Figure 14:
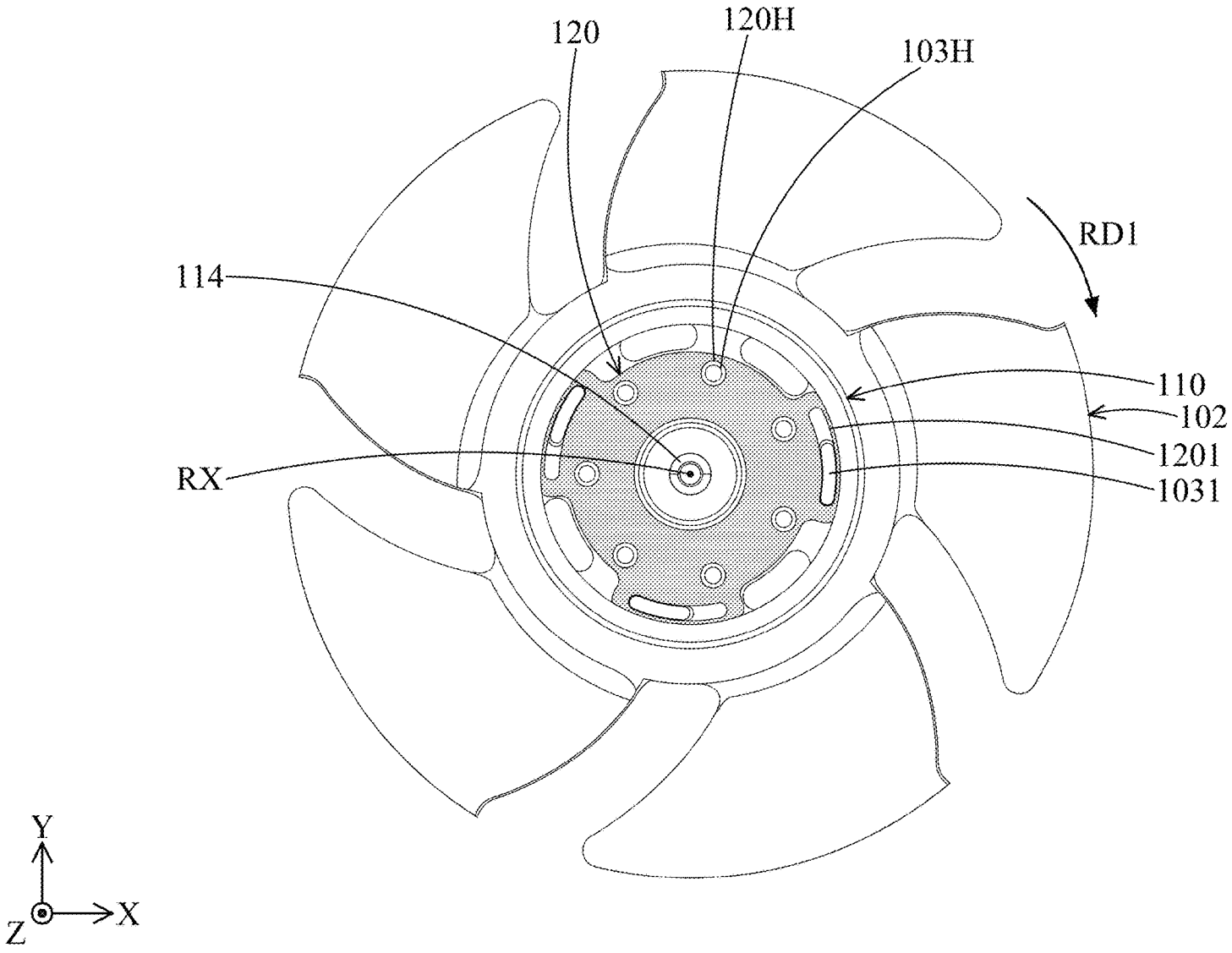
FIG. 14 is a three-dimensional schematic diagram illustrating that the plate member 120 is located in the open position according to another embodiment of the present disclosure.
Figure 15:
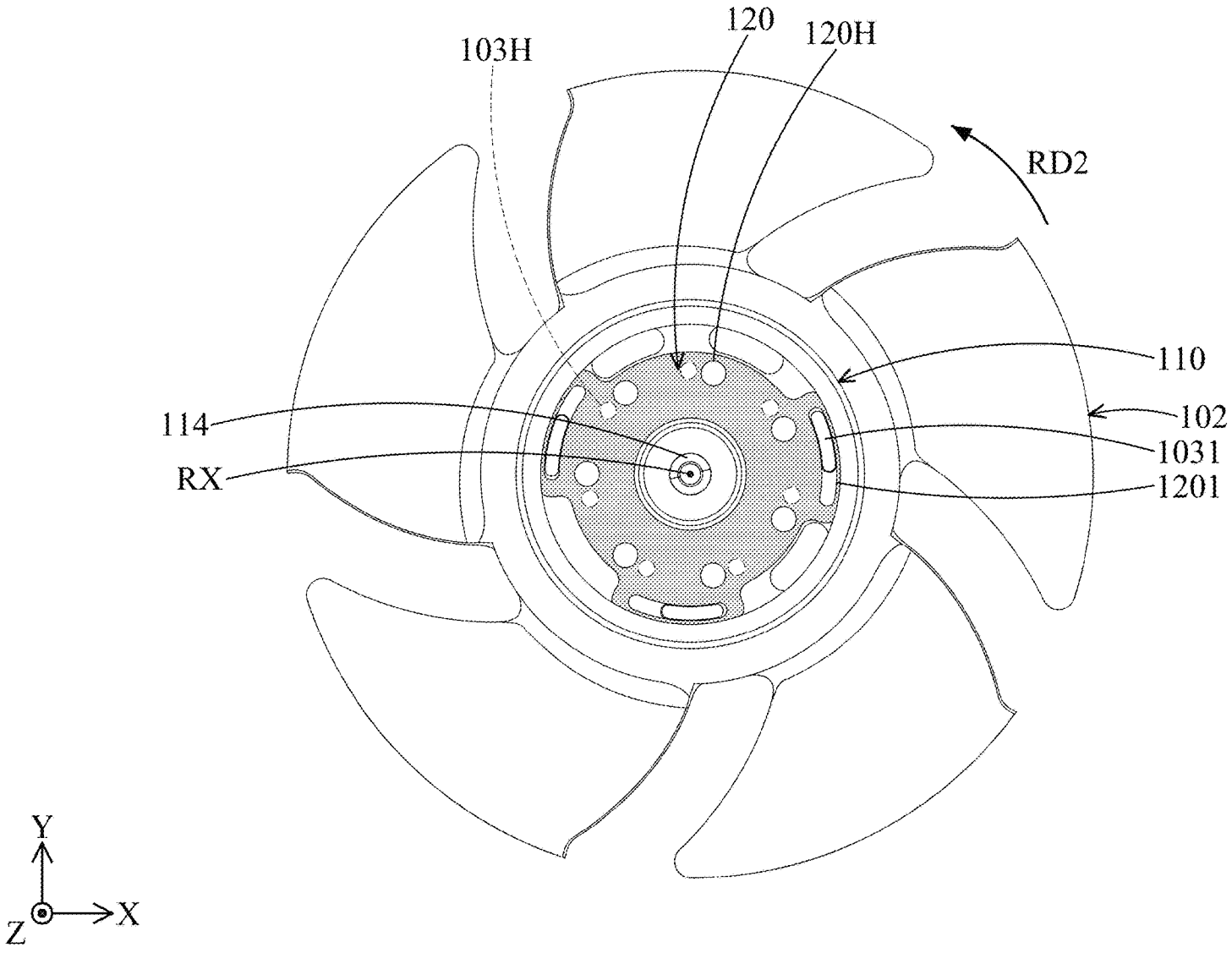
FIG. 15 is a three-dimensional schematic diagram illustrating that the plate member 120 is located in the closed position according to another embodiment of the present disclosure.

Next, please refer to FIG. 12 to FIG. 15. FIG. 12 is an exploded diagram of the rotating assembly 100B according to another embodiment of the present disclosure. FIG. 13 is a perspective cross-sectional view of the rotating assembly 100B according to another embodiment of the present disclosure. FIG. 14 is a three-dimensional schematic diagram illustrating that the plate member 120 is located in the open position according to another embodiment of the present disclosure. FIG. 15 is a three-dimensional schematic diagram illustrating that the plate member 120 is located in the closed position according to another embodiment of the present disclosure.

Similar to the previous embodiments, the rotating assembly 100B has the blade assembly 102, the rotating shaft assembly 110 and the plate member 120. In this embodiment, the rotating shaft assembly 110 is fixedly disposed on the bottom plate 1030, and the rotating shaft assembly 110 has at least one first slot 1121 and at least one second opening 112H. The first slot 1121 corresponds to the protrusion 1031 on the bottom plate 1030, and the second opening 112H corresponds to the first opening 103H on the bottom plate 1030.

Furthermore, the plate member 120 is movably disposed on the rotating shaft assembly 110, and the plate member 120 has at least one second slot 1201. The second slot 1201 is sleeved on the corresponding protrusion 1031, and the size of the second slot 1201 is larger than the size of the protrusion 1031.

As shown in FIG. 14, when the rotating shaft assembly 110 drives the blade assembly 102 to rotate, the protrusion 1031 is in contact with one side of the second slot 1201 (the lower side in FIG. 14) to drive the plate member 120 to rotate relative to the rotating shaft assembly 110 so that the third opening 120H is aligned with the second opening 112H and the first opening 103H to expose the first opening 103H. At this time, the third opening 120H completely overlaps the corresponding first opening 103H and second opening 112H.

On the other hand, as shown in FIG. 15, when the rotating shaft assembly 110 rotates in the second rotational direction RD2, the protrusion 1031 is in contact with the other side of the second slot 1201 (the upper side in FIG. 15) to drive the plate member 120 to rotate in the second rotational direction RD2 relative to the rotating shaft assembly 110, so that the plate member 120 shields the first opening 103H.

Similarly, the rotating assembly 100B also includes a blocking member 130, which is fixedly disposed on the shaft 114 of the rotating shaft assembly 110. As shown in FIG. 13, when viewed in a direction perpendicular to the shaft 114 (such as the Y-axis), the plate member 120 is disposed between the blocking member 130 and a bottom plate 1120 of the second base body 112 (and the bottom plate 1030) in order to avoid the problem that the plate member 120 may be detached from the rotating shaft assembly 110. There is a gap between the blocking member 130 and the plate member 120 to ensure that the plate member 120 can rotate relative to the second base body 112.

Figure 16:
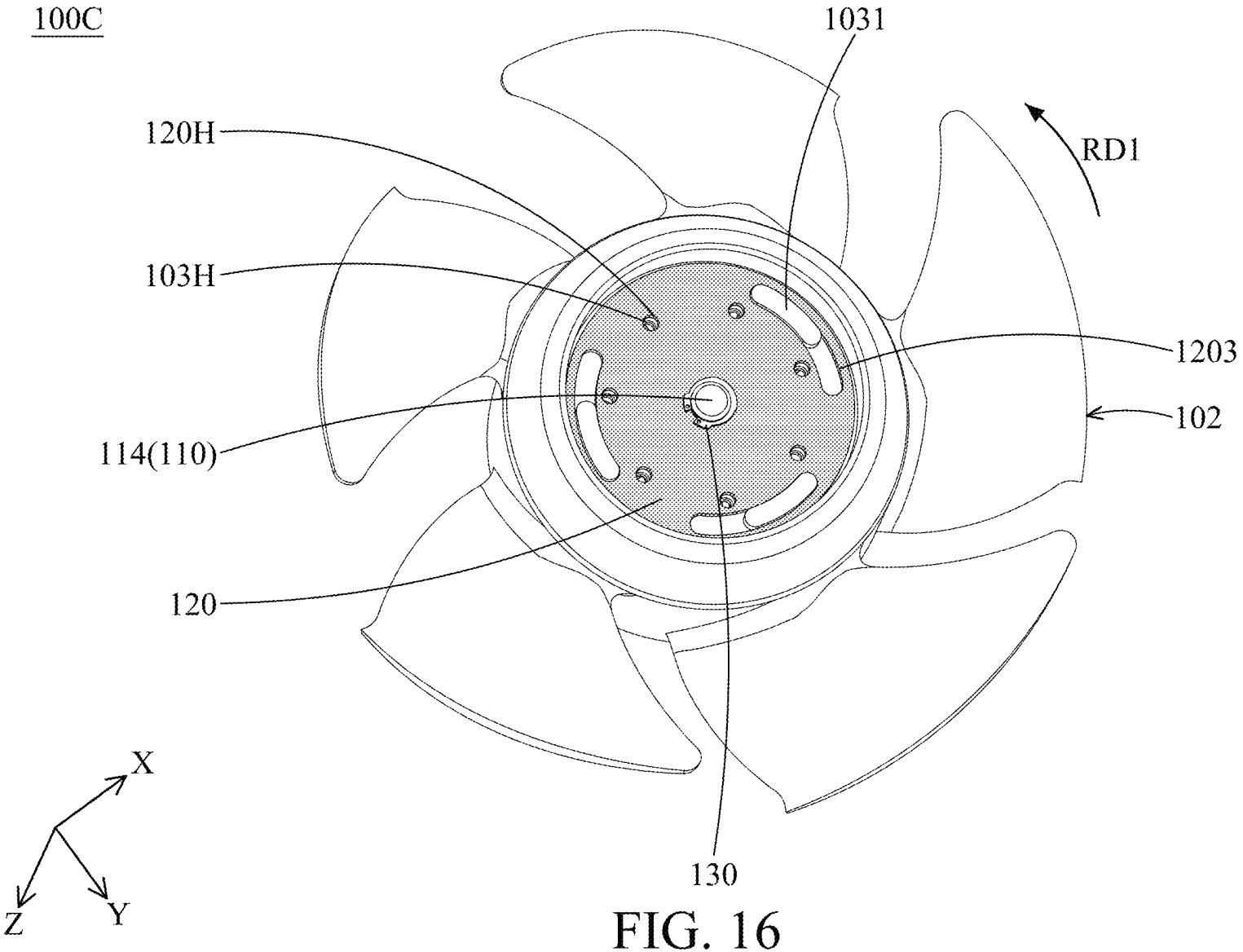
FIG. 16 is a schematic three-dimensional diagram illustrating that the plate member 120 is located in an open position according to another embodiment of the present disclosure.
Figure 17:
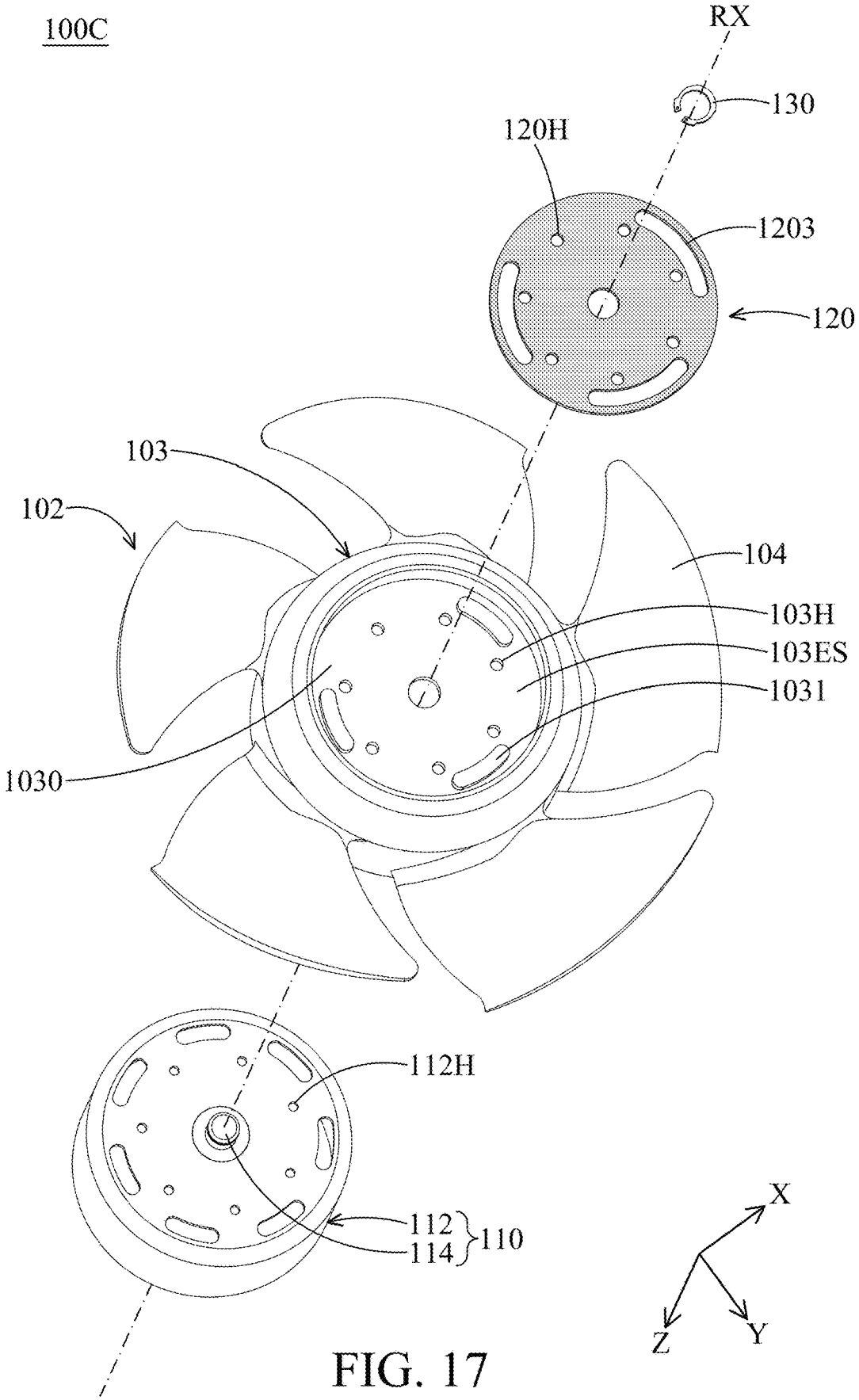
FIG. 17 is an exploded diagram of a rotating assembly 100C according to another embodiment of the present disclosure.
Figure 18:
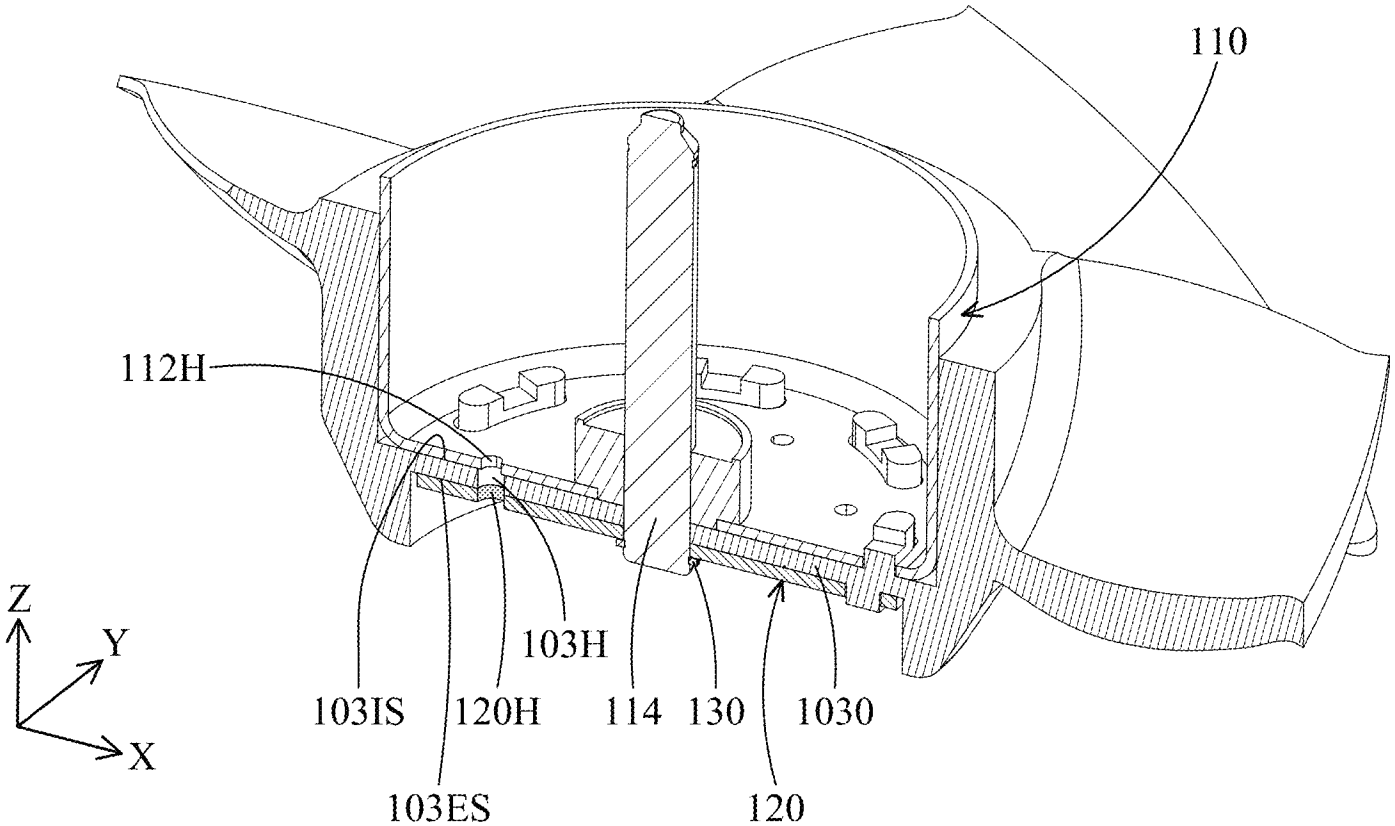
FIG. 18 is a three-dimensional cross-sectional view of the rotating assembly 100C according to another embodiment of the present disclosure.
Figure 19:
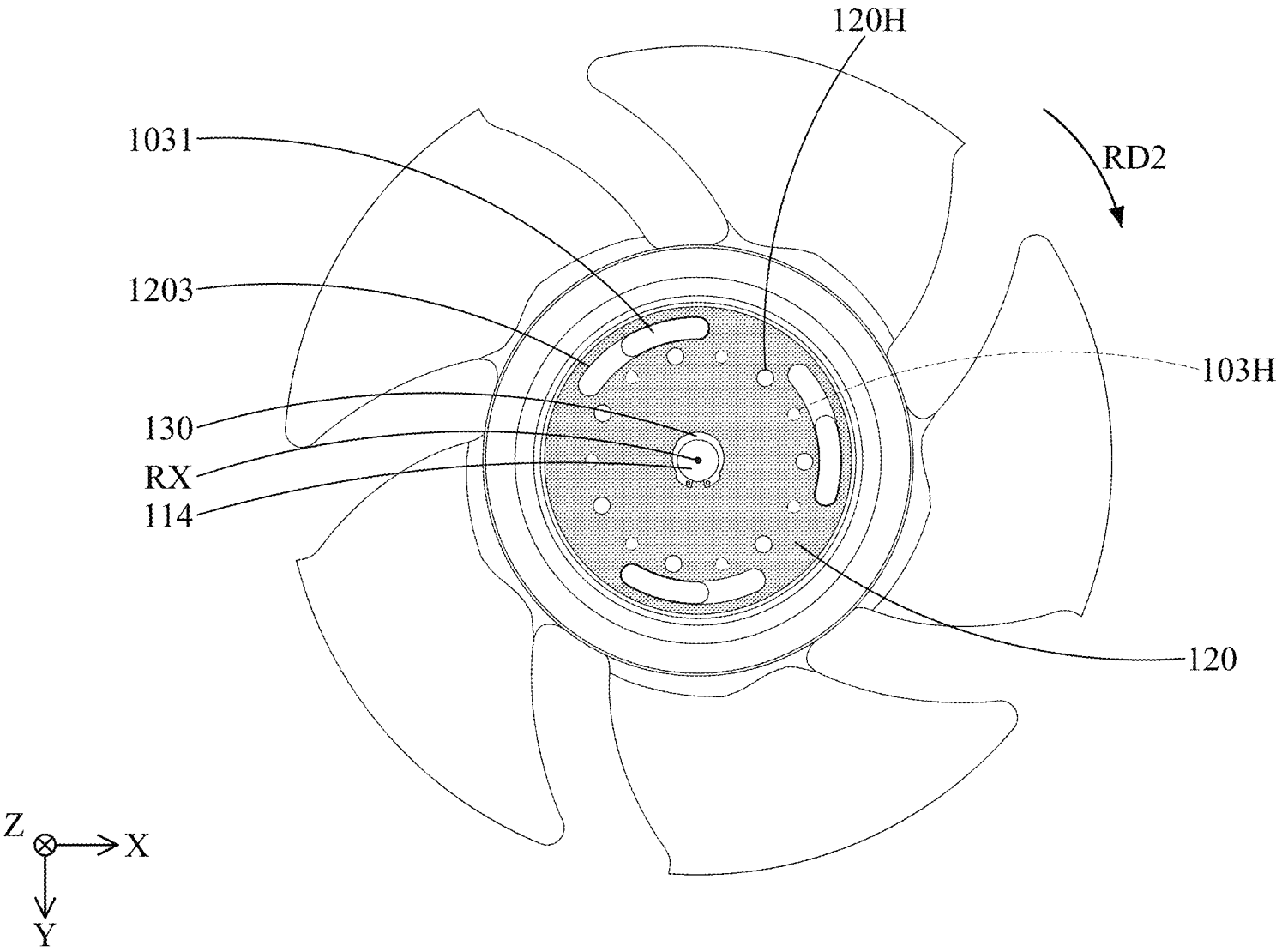
FIG. 19 is a schematic diagram illustrating that the plate member 120 is located in a closed position according to another embodiment of the present disclosure.

Next, please refer to FIG. 16 to FIG. 19. FIG. 16 is a schematic three-dimensional diagram illustrating that the plate member 120 is located in an open position according to another embodiment of the present disclosure. FIG. 17 is an exploded diagram of a rotating assembly 100C according to another embodiment of the present disclosure. FIG. 18 is a three-dimensional cross-sectional view of the rotating assembly 100C according to another embodiment of the present disclosure. FIG. 19 is a schematic diagram illustrating that the plate member 120 is located in a closed position according to another embodiment of the present disclosure.

Similar to the previous embodiment, the rotating assembly 100C has the blade assembly 102, the rotating shaft assembly 110 and a plate member 120. In this embodiment, at least one first opening 103H and at least one protrusion 1031 are formed on the bottom plate 1030 of the first base body 103 of the blade assembly 102, and the protrusion 1031 is formed from an outer surface 103ES of the bottom plate 1030.

As shown in FIG. 18, the rotating shaft assembly 110 is fixedly disposed on an inner surface 103IS of the bottom plate 1030, the rotating shaft assembly 110 has at least one second opening 112H, and the at least one second opening 112H corresponds to the first opening 103H. Furthermore, the plate member 120 is movably disposed on the outer surface 103ES, and the plate member 120 has at least one opening groove 1203. The opening groove 1203 is sleeved on the corresponding protrusion 1031, and the size of the opening groove 1203 is larger than the size of the protrusion 1031.

As shown in FIG. 16, when the rotating shaft assembly 110 drives the blade assembly 102 to rotate in the first rotational direction RD1, the protrusion 1031 is in contact with one side of the opening groove 1203 (the left side in FIG. 16), so as to drive the plate member 120 to rotate relative to the bottom plate 1030, so that the third opening 120H is aligned with the second opening 112H and the first opening 103H to expose the first opening 103H. At this time, the third opening 120H completely overlaps the corresponding first opening 103H and second opening 112H.

In addition, as shown in FIG. 19, when the rotating shaft assembly 110 rotates in the second rotational direction RD2, the first protrusion 1123 is in contact with the other side of the opening groove 1203 (the right side in FIG. 19) to drive the plate member 120 to rotate in the second rotational direction RD2 relative to the bottom plate 1030, so that the plate member 120 shields the first opening 103H.

Similarly, the rotating assembly 100C also includes a blocking member 130, which is fixedly disposed on the shaft 114 of the rotating shaft assembly 110, and as shown in FIG. 18, when viewed in a direction perpendicular to the shaft 114 (the Y-axis), the plate member 120 is disposed between the blocking member 130 and the bottom plate 1030, and there is a gap between the blocking member 130 and the plate member 120 to ensure that the plate member 120 can rotate relative to the bottom plate 1030.

In conclusion, the present disclosure provides a fan module 10 which includes a blade assembly 102, a rotating shaft assembly 110 and a plate member 120. In some embodiments, the rotating shaft assembly 110 is affixed to the blade assembly 102, at least one first opening 103H is formed on the first base body 103 of the blade assembly 102, and at least one second opening 112H is formed on the second base body 112 of the rotating shaft assembly 110 for aligning with the first opening 103H. At least one third opening 120H is formed on the plate member 120 for corresponding to the first opening 103H and the second opening 112H.

When the fan module 10 is operating normally, the rotating shaft assembly 110 drives the blade assembly 102 to rotate, and the plate member 120 rotates with the blade assembly 102 so that the third opening 120H is aligned with the first opening 103H and the second opening 112H, and therefore the fan module 10 can effectively dissipate heat during operation.

Before the operation of the fan module 10 is stopped, the rotating shaft assembly 110 can be rotated in the opposite direction or the rotation speed can be reduced, so that the plate member 120 rotates relative to the blade assembly 102 or the rotating shaft assembly 110, thereby shielding the first opening 103H and the second opening 112H. Therefore, after the fan module 10 stops operating, it can effectively isolate external dust or moisture from entering its interior, thereby increasing the service life of the fan module 10.

Although the embodiments and their advantages have been described in detail, it should be understood that various changes, substitutions, and alterations can be made herein without departing from the spirit and scope of the embodiments as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein can be utilized according to the disclosure. Accordingly, the appended claims are intended to include within their scope such processes, machines, manufacture, compositions of matter, means, methods, or steps. In addition, each claim constitutes a separate embodiment, and the combination of various claims and embodiments are within the scope of the disclosure.

What is claimed is:

1. A fan module, comprising:

a blade assembly, having a plurality of fan blades and a bottom plate, wherein the bottom plate is connected to the fan blades, and at least one first opening and at least one protrusion are formed on the bottom plate;

a rotating shaft assembly, affixed to the bottom plate, wherein the rotating shaft assembly has at least one first slot and at least one second opening, the first slot corresponds to the at least one protrusion, and the at least one second opening corresponds to the at least one first opening; and a plate member, movably disposed between the bottom plate and the rotating shaft assembly, and the plate member having at least one second slot, wherein the at least one second slot is sleeved on the at least one protrusion, and a size of the at least one second slot is greater than a size of the at least one protrusion;

wherein when the rotating shaft assembly drives the blade assembly to rotate, the plate member rotates relative to the bottom plate, thereby selectively shielding the first opening or exposing the first opening.

2. The fan module as claimed in claim 1, wherein the plate member further has at least one third opening, and when the plate member rotates relative to the bottom plate to expose the at least one first opening, the at least one third opening overlaps the at least one first opening and the at least one second opening.

3. The fan module as claimed in claim 2, wherein the at least one protrusion has a platform structure and a protruding structure, the platform structure extends from the bottom plate along a rotating axis of the rotating shaft assembly, and the protruding structure extends and protrudes from the platform structure along the rotating axis.

4. The fan module as claimed in claim 3, wherein the plate member further has a disc structure and a lateral protruding structure, the lateral protruding structure extends radially from the disc structure, the at least one third opening is formed on the disc structure, and the at least one second slot is formed on the lateral protruding structure.

5. The fan module as claimed in claim 4, wherein a thickness of the plate member is less than a height of the platform structure along the rotating axis.

6. The fan module as claimed in claim 4, wherein the at least one second slot is sleeved on the platform structure, and a shape of the platform structure corresponds to a shape of the at least one second slot, so that the platform structure guides the lateral protruding structure to move relative to the bottom plate.

7. The fan module as claimed in claim 4, wherein the platform structure is configured to support the rotating shaft assembly, a size of the at least one first slot matches a size of the protruding structure, and the size of the at least one first slot is smaller than a size of the platform structure.

8. The fan module as claimed in claim 7, wherein the blade assembly is made of a plastic material, and the protruding structure is processed through a hot melt process or a hot riveting process, so that the rotating shaft assembly is affixed to the blade assembly through the protruding structure which is processed by the hot melt process or the hot riveting process.

9. The fan module as claimed in claim 2, wherein when the rotating shaft assembly rotates in a first rotational direction, the plate member rotates in the first rotational direction relative to the bottom plate, so that the at least one third opening overlaps the at least one first opening to expose the at least one first opening.

10. The fan module as claimed in claim 9, wherein when a rotating speed of the rotating shaft assembly in the first rotational direction decreases, a rotating speed of the plate member in the first rotational direction is greater than a rotating speed of the blade assembly and the rotating shaft assembly, so that the plate member shields the at least one first opening.

11. The fan module as claimed in claim 9, wherein when the rotating shaft assembly rotates in a second rotational direction, the plate member rotates in the second rotational direction relative to the bottom plate, so that the plate member shields the at least one first opening, wherein the second rotational direction is opposite to the first rotational direction.

12. A fan module, comprising:

a blade assembly, having a plurality of fan blades and a bottom plate, wherein the bottom plate is connected to the fan blades, and at least one first opening is formed on the bottom plate;

a rotating shaft assembly, affixed to the bottom plate, wherein the rotating shaft assembly has at least one first protrusion and at least one second opening, and the at least one second opening corresponds to the at least one first opening; and a plate member, movably disposed on the rotating shaft assembly, and the plate member having at least one opening groove, wherein the at least one opening groove is sleeved on the at least one first protrusion, and a size of the at least one opening groove is greater than a size of the at least one first protrusion;

wherein when the rotating shaft assembly drives the blade assembly to rotate, the plate member rotates relative to the bottom plate, thereby selectively shielding the first opening or exposing the first opening.

13. The fan module as claimed in claim 12, wherein the fan module further includes a blocking member, which is fixedly disposed on a shaft of the rotating shaft assembly, and when viewed in a direction perpendicular to the shaft, the plate member is disposed between the blocking member and the bottom plate, wherein there is a gap between the blocking member and the plate member.

14. The fan module as claimed in claim 13, wherein at least one second protrusion is formed on the bottom plate and passes through the rotating shaft assembly, the plate member has a disc structure, and the disc structure does not contact the at least one second protrusion, wherein the plate member further has at least a third opening corresponding to the at least one second opening, and when viewed along a rotating axis of the shaft, the at least one third opening is located between the at least one second protrusion and the at least one first protrusion.

15. A fan module, comprising:

a blade assembly, having a plurality of fan blades and a bottom plate, wherein the bottom plate is connected to the fan blades, and at least one first opening and at least one protrusion are formed on the bottom plate;

a rotating shaft assembly, fixedly disposed on the bottom plate, and the rotating shaft assembly having at least one first slot and at least one second opening, wherein the first slot corresponds to the at least one protrusion, and the at least one second opening corresponds to the at least one first opening; and a plate member, movably disposed on the rotating shaft assembly, and the plate member having at least one second slot, wherein the at least one second slot is sleeved on the at least one protrusion, and a size of the at least one second slot is greater than a size of the at least one protrusion, wherein when the rotating shaft assembly drives the blade assembly to rotate, the plate member rotates relative to the rotating shaft assembly, thereby selectively shielding the first opening or exposing the first opening.

16. The fan module as claimed in claim 15, wherein the fan module further includes a blocking member which is fixedly disposed on a shaft of the rotating shaft assembly, and when viewed in a direction perpendicular to the shaft, the plate member is disposed between the blocking member and the bottom plate, wherein there is a gap between the blocking member and the plate member.

17. The fan module as claimed in claim 15, wherein the plate member further has at least one third opening corresponding to the at least one first opening and the at least one second opening, and when the plate member rotates relative to the bottom plate to expose the at least one first opening, the at least one third opening overlaps the at least one first opening and the at least one second opening.

18. A fan module, comprising:

a blade assembly, having a plurality of fan blades and a bottom plate, wherein the bottom plate is connected to the fan blades, at least one first opening and at least one protrusion are formed on the bottom plate, and the at least one protrusion is formed from an outer surface of the bottom plate;

a rotating shaft assembly, fixedly disposed on an inner surface of the bottom plate, and the rotating shaft assembly having at least one second opening, wherein the at least one second opening corresponds to the at least one first opening; and a plate member, movably disposed on the outer surface, and the plate member having at least one opening groove, wherein the at least one opening groove is sleeved on the at least one protrusion, and a size of the at least one opening groove is greater than a size of the at least one protrusion;

wherein when the rotating shaft assembly drives the blade assembly to rotate, the plate member rotates relative to the bottom plate, thereby selectively shielding the first opening or exposing the first opening.

19. The fan module as claimed in claim 18, wherein the fan module further includes a blocking member which is fixedly disposed on a shaft of the rotating shaft assembly, and when viewed in a direction perpendicular to the shaft, the plate member is disposed between the blocking member and the bottom plate, wherein there is a gap between the blocking member and the plate member.

20. The fan module as claimed in claim 18, wherein the plate member further has at least one third opening corresponding to the at least one first opening, and when the plate member rotates relative to the bottom plate to expose the at least one first opening, the at least one third opening overlaps the at least one first opening and the at least one second opening.

* * * * *